US006184180B1

(12) United States Patent
Maruyama et al.

(10) Patent No.: US 6,184,180 B1
(45) Date of Patent: Feb. 6, 2001

(54) REVERSIBLE HEAT-SENSITIVE RECORDING MATERIAL

(75) Inventors: Jun Maruyama; Hidekazu Sano, both of Tokyo (JP)

(73) Assignee: Mitsubishi Paper Mills Limited, Tokyo (JP)

( * ) Notice: Under 35 U.S.C. 154(b), the term of this patent shall be extended for 0 days.

(21) Appl. No.: 09/285,782

(22) Filed: Apr. 5, 1999

(30) Foreign Application Priority Data

| | | |
|---|---|---|
| Apr. 6, 1998 | (JP) | 10-093313 |
| Nov. 6, 1998 | (JP) | 10-315250 |
| Jan. 11, 1999 | (JP) | 11-0033801 |
| Mar. 16, 1999 | (JP) | 11-069787 |

(51) Int. Cl.[7] ..... B41M 5/30
(52) U.S. Cl. ..... 503/216; 503/201; 503/205
(58) Field of Search ..... 503/201, 205, 503/216

(56) References Cited

U.S. PATENT DOCUMENTS

| | | | |
|---|---|---|---|
| 5,395,815 | 3/1995 | Ikeda et al. | 503/216 |
| 5,498,772 | 3/1996 | Maruyama et al. | 503/216 |
| 5,955,225 | 9/1999 | Furuya et al. | 430/19 |

FOREIGN PATENT DOCUMENTS

| | | |
|---|---|---|
| 19680319C2 | 6/1997 | (DE) . |
| 0 492 628 A1 | 12/1991 | (EP) . |
| 0873881A1 | 10/1998 | (EP) . |

*Primary Examiner*—Bruce H. Hess
(74) *Attorney, Agent, or Firm*—Pillsbury Madison & Sutro Intellectual Property Group, LLP

(57) ABSTRACT

Disclosed is a reversible heat-sensitive recording material comprising a support and a reversible heat-sensitive recording layer containing a dye precursor which is usually colorless or a pale color and a reversible color developing agent capable of causing a reversible change in color density of the dye precursor due to the difference in cooling rate after heating, and the reversible color developing agent is a compound represented by the following formula (I):

(I)

wherein $R^1$ and $R^2$ may be the same or different from each other and each represent a $C_{1-18}$ divalent hydrocarbon group; $R^3$ represents a $C_{1-24}$ hydrocarbon group; $X^1$ represents a divalent connecting group having at least one —CONH— bonding; $X^2$ represents an oxygen atom or a sulfur atom; n is an integer of 1 to 3; and m is 0 or 1.

6 Claims, No Drawings

REVERSIBLE HEAT-SENSITIVE RECORDING MATERIAL

BACKGROUND OF THE INVENTION

1. Field of the Invention

This invention relates to reversible heat-sensitive recording materials in which formation of images and decolorization of the images can be carried out by controlling the heat energy.

2. Prior Art

Heat-sensitive recording materials generally comprise a support and, provided thereon, a heat-sensitive recording layer mainly composed of a normally electron donating colorless or slightly colored dye precursor and an electron accepting color developer. The dye precursor and the color developer instantaneously react upon application of heat by thermal head, thermal pen, laser beams or the like to form an image. Such heat-sensitive recording materials are disclosed in Japanese Patent Application Kokoku Nos. 43-4160, 45-14039 and the like.

In general, in the case of these heat-sensitive materials, when an image is once formed, it is impossible to erase the image to restore the portion to the original state. Therefore, for further recording of information, it is only possible to make recording in the portions where no image is formed. Accordingly, the area for heat-sensitive recording is limited and the information to be recorded is restricted and not all of the necessary information can be recorded.

Recently, reversible heat-sensitive recording materials capable of repeating the formation of images and the decolorization of the images have been proposed for solving the above problems. For example, Japanese Patent Application Kokai Nos. 54-119377, 63-39377, 63-41186 and the like, disclose dispersed in the matrix resin. However, in these recording materials, the transparency of the recording materials is reversibly changed and so the contrast between the imaged portion and the unimaged portion is insufficient.

Furthermore, according to the methods described in Japanese Patent Application Kokai Nos. 50-81157 and 50-105555, since the images formed by these methods change depending on the environmental temperatures, the temperature at which the image-formed state is maintained differs from the temperature at which the image-erased state is maintained and so these two states cannot be maintained for a desired period at room temperature.

Further, Japanese Patent Application Kokai No. 59-120492 mentions a method for maintaining the image-formed state and the image-erased state by keeping the recording material in the region of the hysteresis temperature utilizing the hysteresis characteristics of color forming components. However, this method has the defects that a heating source are needed for formation and decolorization of images and besides, the temperature region at which the image-formed state and the image-erased state can be maintained is limited to the region of the hysteresis temperature. Thus, this method is still not sufficient for using the materials in the temperature environment of daily life.

In addition, Japanese Patent Application Kokai Nos. 2-188293 and 2-188294 and International Patent Publication No. WO90/11898 disclose reversible heat-sensitive recording media comprising a leuco dye and a color developing and decolorizing agent which causes color formation of the leuco dye upon heating and causes decolorization of the color. The color developing and decolorizing agents are amphoteric compounds having an acidic group which causes color formation of the leuco dye and a basic group which causes decolorization of the leuco dye and they preferentially cause one of the color formation action of the acidic group and the decolorization action of the basic group by controlling the heat energy, thereby to perform the color formation and decolorization. However, according to this method, it is impossible to completely exchange the color forming reaction and the decolorizing reaction from each other only by control of heat energy and since both the reactions simultaneously take place at a certain ratio, sufficient color density cannot be obtained and besides the decolorization cannot completely performed. For this reason, a sufficiently high contrast of the image cannot be obtained. Moreover, since the decolorizing action of the basic group acts also on the color formed portion at room temperature, the density of the color formed portion inevitably decreases with time.

Furthermore, in Japanese Patent Application Kokai No. 5-124360, reversible heat-sensitive recording media which can form images and erase images by heating a leuco dye is described, and as an electron-receiving compound (reversible color developing agent), there are exemplified an organic phosphoric acid compound, α-hydroxyaliphatic carboxylic acid, aliphatic dicarboxylic acid and a specific phenol compound such as an alkylthiophenol, an alkyloxyphenol, an alkylcarbamoylphenol, alkyl gallate each having a carbon number of 12 or more, etc. However, in this recording media, coloring density is low or decolorization of images becomes incomplete so that the two problems cannot be solved simultaneously and image stability with time is also not practically satisfied. Moreover, in Japanese Patent Application Kokai No. 5-294063, as a decolorization promoting agent for improving decolorizability of the above-mentioned reversible heat-sensitive recording media, there are described an aliphatic acid derivative, wax, higher alcohol, respective esters of phosphoric acid/benzoic acid/phthalic acid or oxy acid, silicone oil, liquid crystal compound, surfactant and aliphatic acid saturated hydrocarbon having 10 or more carbon atoms or the like, but these effects are small so that it cannot be said that it can be practically used since an image density at the time of erasing is yet high.

Recently, in Japanese Patent Application Kokai No. 10-67726, as a reversible color developing agent, a phenol compound having a long chain alkyl group in which specific connecting groups are combined is exemplified and a contrast of color forming and color erasing has been improved. However, even when the reversible color developing agent is used, stability of the recorded image with a lapse of time is not satisfied. And yet, there is a problem that a sufficient color forming density cannot be obtained depending on a leuco dye to be used in combination.

On the other hand, the present inventors have found reversible color developing agents which have a high possibility for practical use as proposed in Japanese Patent Applications Kokai No. 6-210954 and No. 7-179043. However, even when these agents are used, there is much room for further improvement in the points of obtaining stability of the above recording image with a lapse of time or a sufficient color forming density irrespective of the kind of the leuco dyes.

As explained above, according to the conventional technique, there have been no reversible heat-sensitive recording materials which can give good image contrast, can form images and erase the images and can maintain images having time stability under the daily environment.

SUMMARY OF THE INVENTION

An object of the present invention is to provide reversible heat-sensitive recording materials which can form images and erase the images with a good contrast and can maintain images having time stability under the daily environment. More specifically, it is an object of the present invention to provide reversible heat-sensitive recording materials which have a large contrast at color forming and color erasing irrespective of the kinds of leuco dyes, little image remained without discolorization (or erasing), and as for the erasing time and erasing temperature, which are capable of uniform erasing with a shorter time, low temperature and a broad temperature region.

As a result of intensive research in a reversible heat-sensitive recording material comprising a support and a reversible heat-sensitive recording layer containing a dye precursor which is usually colorless or a pale color and a reversible color developing agent capable of causing a reversible change in color density of said dye precursor due to the difference in cooling rate after heating, by using a compound represented by the following formula (I) as said reversible color developing agent or adding at least one of the specific compounds represented by the following formulae (II) to (IX) as a decolorization promoting agent, the present inventors have found that reversible heat-sensitive recording materials which have a large contrast at color forming and color erasing irrespective of the kinds of leuco dyes, little image remained without discolorization (or erasing), and as for the erasing time and erasing temperature, which are capable of uniform erasing with a shorter time, low temperature and a broad temperature region can be obtained whereby they have accomplished the present invention.

That is, the reversible heat-sensitive recording material of the present invention comprises a support and a reversible heat-sensitive recording layer containing a dye precursor which is usually colorless or a pale color and a reversible color developing agent capable of causing a reversible change in color density of said dye precursor due to the difference in cooling rate after heating, and said reversible color developing agent is a compound represented by the following formula (I):

(I)

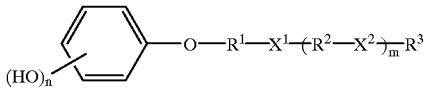

wherein $R^1$ and $R^2$ may be the same or different from each other and each represent a divalent hydrocarbon group having 1 to 18 carbon atoms; $R^3$ represents a hydrocarbon group having 1 to 24 carbon atoms; $X^1$ represents a divalent connecting group having at least one —CONH— bonding; $X^2$ represents an oxygen atom or a sulfur atom; n is an integer of 1 to 3; and m is 0 or 1.

In a preferred embodiment of the present invention, the reversible heat-sensitive recording layer further contains, as a decolorization promoting agent, at least one of the compounds represented by the following formulae (II) to (IX):

$$A—(Ra)_h—Xa—Rb \quad (II)$$

wherein A represents a substituent having at least one nitrogen atom; Ra represents a divalent hydrocarbon group having 1 to 12 carbon atoms; Xa represents a divalent group having at least one —CONH— bonding; Rb represents a hydrocarbon group having 1 to 24 carbon atoms, and an oxygen atom or a sulfur atom may be contained in the group; and h represents 0 or 1.

(III)

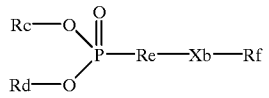

wherein Rc and Rd may be the same or different from each other and each represent a hydrocarbon group having 1 to 24 carbon atoms; Re represents a divalent hydrocarbon group having 1 to 12 carbon atoms; Rf represents a hydrocarbon group having 1 to 28 carbon atoms, and an oxygen atom or a sulfur atom may be contained in the group; and Xb represents a divalent group having at least one —CONH— bonding.

(IV)

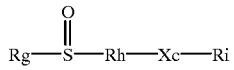

wherein Rg and Ri may be the same or different from each other and each represent a hydrocarbon group having 1 to 24 carbon atoms; Rh represents a divalent hydrocarbon group having 1 to 12 carbon atoms; and Xc represents a divalent group having at least one —CONH— bonding.

(V)

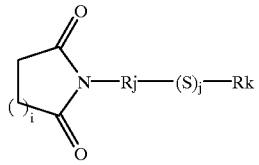

wherein Rj represents a divalent hydrocarbon group having 1 to 12 carbon atoms; Rk represents a hydrocarbon group having 1 to 24 carbon atoms; i is an integer of 1 to 3; and j represents 0 or 1.

(VI)

wherein Rl represents a divalent hydrocarbon group having 1 to 24 carbon atoms; Rm represents a divalent hydrocarbon group having 1 to 12 carbon atoms; Xd represents a divalent group having at least one —CONH— bonding; and k represents 0 or 1, provided that when k=0, Xd does not contain a mere amido bonding.

(VII)

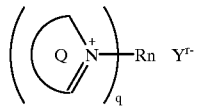

wherein Q represents a heterocyclic aromatic ring; Rn represents a monovalent or more of hydrocarbon atoms having 6 to 24 carbon atoms; q is an integer of 1 or 2; Y represents an anion; and r is a number necessary for adjusting the charge in the molecule to 0.

(VIII)

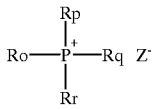

wherein Ro, Rp, Rq and Rr may be the same or different from each other and each represent an alkyl group, an alkenyl group, a cycloalkyl group, an aralkyl group, an aryl group or a heterocyclic residue, and optional two groups selected from Ro to Rr may be combined to each other to form a cyclic structure; and $Z^-$ represents an anion.

(IX)

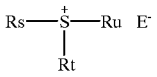

wherein Rs, Rt and Ru may be the same or different from each other and each represent an alkyl group, an alkenyl group, a cycloalkyl group, an aralkyl group, an aryl group or a heterocyclic residue, and optional two groups selected from Rs to Ru may be combined to each other to form a cyclic structure; and $E^-$ represents an anion.

DESCRIPTION OF THE PREFERRED EMBODIMENTS

In the compound represented by the formula (I), $R^1$ and $R^2$ each represent a divalent hydrocarbon having 1 to 18 carbon atoms, $R^1$ is preferably a divalent hydrocarbon group having 1 to 11 carbon atoms, and $R^2$ is preferably a divalent hydrocarbon group having 2 to 11 carbon atoms. $R^3$ represents a hydrocarbon group having 1 to 24 carbon atoms, preferably a hydrocarbon group having 6 to 11 carbon atoms. Moreover, it is more preferred that the total carbon atoms of $R^1$, $R^2$ and $R^3$ are 11 to 30, and particularly preferably that they are aliphatic hydrocarbon groups having the total carbon atoms of 11 to 30. The sum of the carbon atoms relates to a color forming property, a color erasing property and an image storage property. If the sum of the carbon atoms is less than 11, a color forming property is good but a color erasing property and an image storage property tend to be worse, while if the sum of the carbon atoms is more than 30, a color erasing property and image an image storage property are good but a color forming property is tend to be worse. Thus, if the total carbon atoms are within the above range, the resulting recording material is well-balanced without impairing a contrast of color forming and color erasing and an image storage property. $R^1$, $R^2$ and $R^3$ each specifically represent an alkylene group or an alkyl group, and an aromatic ring may be contained in the respective groups, particularly in the case of $R^1$ and $R^2$, they may comprise aromatic rings alone.

Also, $X^1$ in the formula (I) represents a divalent group having at least one —CONH— bond, and specific examples thereof may include an amide (—CONH—, —NHCO—), urea (—NHCONH—), urethane (—NHCOO—, —OCONH—), diacylamine (—CONHCO—), diacylhydrazide (—CONHNHCO—), oxalic acid diamide (—NHCOCONH—), acyl urea (—CONHCONH—, —NHCONHCO—), 3-acylcarbazinic acid ester (—CONHNHCOO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1-acylamino-1-ureidomethane (—$CONHCH_2NHCONH$—, —$NHCONHCH_2NHCO$—), malonamide (—$NHCOCH_2CONH$—) and the like. Of these, as $X^1$, urea, diacylhydrazide, oxalic acid diamide, acylsemicarbazide and diacylaminomethane are preferred. Moreover, $X^2$ represents an oxygen atom or a sulfur atom, and due to easiness in preparation, a sulfur atom is preferred.

The compound represented by the formula (I) is an electron-accepting compound, and has an ability of color-forming a leuco dye and also has specifically a color erasing effect, i.e., a reversible effect. Incidentally, in an electron-accepting compound which has been used in the usual heat-sensitive recording material such as 2,2-bis(4-hydroxyphenyl)propane, bis(4-hydroxyphenyl)sulfone, 4-hydroxybenzoic acid benzyl, etc., such a reversible effect is never observed. In the following, specific examples of a reversible color developing agent represented by the formula (I) are mentioned but the present invention is not limited by these examples.

First, as examples of the compound wherein m=0, there may be mentioned N-n-dodecyl-2-(p-hydroxyphenoxy) acetamide, N-n-octadecyl-2-(p-hydroxyphenoxy)acetamide, N-n-decyl-3-(p-hydroxyphenoxy) propanamide, N-n-octadecyl-3-(p-hydroxyphenoxy)propanamide, N-n-octadecyl-6-(p-hydroxyphenoxy)hexanamide, N-n-decyl-11-(p-hydroxyphenoxy)undecanamide, N-(p-n-octylphenyl)-6-(p-hydroxyphenoxy)hexanamide, N-n-octadecyl-p-(p-hydroxyphenoxy)benzamide, N-(p-hydroxyphenoxy)methyl-n-dodecanamide, N-(p-hydroxyphenoxy)methyl-n-octadecanamide, N-[2-(p-hydroxyphenoxy)ethyl]-n-octadecanamide, N-[6-(p-hydroxyphenoxy)hexyl]-n-decanamide, N-[p-(p-hydroxyphenoxy)phenyl]-n-octadecanamide, N-[2-(p-hydroxyphenoxy)ethyl]-N'-n-tetradecylurea, N-[2-(p-hydroxyphenoxy)ethyl]-N'-n-octadecylurea, N-[2-(3,4-dihydroxyphenoxy)ethyl]-N'-n-octadecylurea, N-[6-(p-hydroxyphenoxy)hexyl]-N'-n-decylurea, N-[p-(p-hydroxyphenoxy)phenyl]-N'-n-octadecylurea, N-[10-(p-hydroxyphenoxy)ethyl]carbamic acid-n-octadecyl, N-[6-(p-hydroxyphenoxy)hexyl]carbamic acid-n-tetradecyl, N-[p-(p-hydroxyphenoxy)phenyl]carbamic acid-n-dodecyl, N-n-octadecylcarbamic acid-[2-(p-hydroxyphenoxy)ethyl], N-n-decylcarbamic acid-[11-(p-hydroxyphenoxy)undecyl], N-n-tetradecylcarbamic acid-[p-(p-hydroxyphenoxy)phenyl], N-[3-(p-hydroxyphenoxy)propionyl]-N-n-octadecanoylamine, N-[6-(p-hydroxyphenoxy)hexanoyl]-N-n-octadecanoylamine, N-[3-(p-hydroxyphenoxy) propionyl]-N-(p-n-octylbenzoyl)amine, N-[2-(p-hydroxyphenoxy)aceto]-N'-n-dodecanohydrazide, N-[2-(p-hydroxyphenoxy)aceto]-N'-n-octadecanohydrazide, N-[3-(p-hydroxyphenoxy)propiono]-N'-n-octadecanohydrazide, N-[3-(3,4-dihydroxyphenoxy)propiono]-N'-n-octadecanohydrazide, N-[6-(p-hydroxyphenoxy)hexano]-N'-n-tetradecanohydrazide, N-[6-(p-hydroxyphenoxy) hexano]-N'-n-octadecanohydrazide, N-[6-(p-hydroxyphenoxy)hexano]-N'-(p-n-octylbenzo)hydrazide, N-[11-(p-hydroxyphenoxy)undecano]-N'-n-dodecanohydrazide, N-[11-(p-hydroxyphenoxy)undecano]-N'-n-tetradecanohydrazide, N-[11-(p-hydroxyphenoxy) undecano]-N'-n-octadecanohydrazide, N-[11-(p-hydroxyphenoxy)undecano]-N'-(6-phenyl) hexanohydrazide, N-[11-(3,4,5-trihydroxyphenoxy) undecano]-N'-n-octadecanohydrazide, N-[p-(p-hydroxyphenoxy)benzo]-N'-n-octadecanohydrazide, N-[2-(p-hydroxyphenoxy)ethyl]-N'-n-tetradecyloxamide, N-[3-(p-hydroxyphenoxy)propyl]-N'-n-octadecyloxamide, N-[3-(3,4-dihydroxyphenoxy)propyl]-N'-n-octadecyloxamide, N-[11-(p-hydroxyphenoxy)undecyl]-N'-n-decyloxamide, N-[p-(p-hydroxyphenoxy)phenyl]-N'-n-octadecyloxamide, N-[2-(p-hydroxyphenoxy)acetyl]-N'-n-dodecylurea, N-[2-(p-hydroxyphenoxy)acetyl]-N'-n-octadecylurea, N-[3-(p-hydroxyphenoxy)propionyl]-N'-n-octadecylurea, N-[p-(p-hydroxyphenoxy)benzoyl]-N'-n-octadecylurea, N-[2-(p-hydroxyphenoxy)ethyl]-N'-n-dodecanoylurea, N-[2-(p-hydroxyphenoxy)ethyl]-N'-n-octadecanoylurea, N-[p-(p-hydroxyphenoxy)phenyl]-N'-n-octadecanoylurea, 3-[3-(p-hydroxyphenoxy)propionyl]carbazinic acid-n-octadecyl, 3-[11-(p-hydroxyphenoxy)undecanoyl]carbazinic acid-n-decyl, 4-[2-(p-hydroxyphenoxy)ethyl]-1-n-tetradecylsemicarbazide, 4-[2-(p-hydroxyphenoxy)ethyl]-1-n-octadecylsemicarbazide, 4-[2-(p-hydroxyphenoxy)ethyl]-1-n-octadecylsemicarbazide, 4-[p-(p-hydroxyphenoxy)phenyl]-1-n-tetradecylsemicarbazide, 1-[2-(p-hydroxyphenoxy)ethyl]-4-n-tetradecylsemicarbazide, 1-[2-(p-hydroxyphenoxy)ethyl]-4-n-octadecylsemicarbazide, 1-[p-(p-hydroxyphenoxy)phenyl]-4-n-tetradecylsemicarbazide, 1-[2-(p-hydroxyphenoxy)acetyl]-4-n-tetradecylsemicarbazide, 1-[3-(p-hydroxyphenoxy)propionyl]-4-n-octadecylsemicarbazide, 1-[11-(p-hydroxyphenoxy)undecanoyl]-4-n-decylsemicarbazide, 1-[p-(p-hydroxyphenoxy)benzoyl]-4-n-octadecylsemicarbazide, 4-[2-(p-hydroxyphenoxy)ethyl]-1-n-tetradecanoylsemicarbazide, 4-[2-(p-hydroxyphenoxy)ethyl]-1-n-octadecanoylsemicarbazide, 4-[p-(p-hydroxyphenoxy)phenyl]-1-n-octadecanoylsemicarbazide, 1-[2-(p-hydroxyphenoxy)acetamido]-1-n-dodecanoylaminomethane, 1-[2-(p-hydroxyphenoxy)acetamido]-1-n-octadecanoylaminomethane, 1-[3-(p-hydroxyphenoxy)propanamido]-1-n-octadecanoylaminomethane, 1-[11-(p-hydroxyphenoxy)undecanamido]-N'-n-decanoylaminomethane, 1-[p-(p-hydroxyphenoxy)benzamido]-1-n-octadecanoylaminomethane, 1-[2-(p-hydroxyphenoxy)acetamido]-1-(N'-n-dodecylureido)methane, 1-[2-(p-hydroxyphenoxy)acetamido]-1-(N'-n-octadecylureido)methane, 1-[3-(p-hydroxyphenoxy)propanamido]-1-(N'-n-octadecylureido)methane, 1-[11-(p-hydroxyphenoxy)undecanamido]-N'-(N'-n-decylureido)methane, 1-[p-(p-hydroxyphenoxy)benzamido]-1-(N'-n-octadecylureido)methane, 1-{N'-[2-(p-hydroxyphenoxy)ethyl]ureido}-1-n-octadecanoylaminomethane, 1-{N'-[p-(p-hydroxyphenoxy)phenyl]ureido}-1-n-octadecanoylaminomethane, N-[2-(p-hydroxyphenoxy)ethyl]-N'-n-octadecylmalonamide, N-[p-(p-hydroxyphenoxy)phenyl]-N'-n-octadecylmalonamide, etc.

Next, examples of the compound wherein m=1 and X2=sulfur atom may include N-(10-dodecylthio)decyl-2-(p-hydroxyphenoxy)acetamide, N-(2-octadecylthio)ethyl-2-(p-hydroxyphenoxy)acetamide, N-(10-dodecylthio)decyl-3-(p-hydroxyphenoxy)propanamide, N-(2-octadecylthio)ethyl-3-(p-hydroxyphenoxy)propanamide, N-(3-octadecylthio)propyl-6-(p-hydroxyphenoxy)hexanamide, N-(2-decylthio)ethyl-11-(p-hydroxyphenoxy)undecanamide, N-(p-octylthio)phenyl-6-(p-hydroxyphenoxy)hexanamide, N-(2-octadecylthio)ethyl-p-(p-hydroxyphenoxy)benzamide, N-[11-(p-hydroxyphenoxy)undecyl]-6-hexylthiohexanamide, N-[11-(p-hydroxyphenoxy)undecyl]-4-hexylthiobutanamide, N-[2-(p-hydroxyphenoxy)ethyl]-4-octadecylthiobutanamide, N-[6-(p-hydroxyphenoxy)hexyl]-6-decylthiohexanamide, N-[p-(p-hydroxyphenoxy)phenyl]-3-octadecylthiopropionamide, N-[2-(p-hydroxyphenoxy)ethyl]-N'-(2-tetradecylthio)ethylurea, N-[2-(p-hydroxyphenoxy)ethyl]-N'-(2-octadecylthio)ethylurea, N-[2-(3,4-dihydroxyphenoxy)ethyl]-N'-(3-octadecylthio)propylurea, N-[6-(p-hydroxyphenoxy)hexyl]-N'-(2-decylthio)ethylurea, N-[p-(p-hydroxyphenoxy)phenyl]-N'-(2-octadecylthio)ethylurea, N-[10-(p-hydroxyphenoxy)decyl]-N'-(6-hexylthio)hexylurea, N-[2-(p-hydroxyphenoxy)ethyl]carbamic acid-(2-octadecylthio)ethyl, N-[6-(p-hydroxyphenoxy)ethyl]carbamic acid-(3-tetradecylthio)propyl, N-[p-(p-hydroxyphenoxy)phenyl]carbamic acid-(6-dodecylthio)hexyl, N-(2-octadecylthio)ethylcarbamic acid-[2-(p-hydroxyphenoxy)ethyl], N-(3-decylthio)propylcarbamic acid-[1-(p-hydroxyphenoxy)undecyl], N-(3-tetradecylthio)propylcarbamic acid-[p-(p-hydroxyphenoxy)phenyl], N-[3-(p-hydroxyphenoxy)propionyl]-N-(2-octadecylthio)acetylamine, N-[6-(p-hydroxyphenoxy)hexanoyl]-N-(3-octadecylthio)propionylamine, N-[3-(p-hydroxyphenoxy)propionyl]-N-(p-octylthio)benzoylamine, N-[2-(p-hydroxyphenoxy)acet]-N'-(3-dodecylthio)propionohydrazide, N-[2-(p-hydroxyphenoxy)acet]-N'-(2-octadecylthio)acetohydrazide, N-[3-(p-hydroxyphenoxy)propiono]-N'-(3-octadecylthio)propionohydrazide, N-[6-(p-hydroxyphenoxy)hexano]-N'-(6-tetradecylthio)hexanohydrazide, N-[6-(p-hydroxyphenoxy)hexano]-N'-(3-octadecylthio)propionohydrazide, N-[6-(p-hydroxyphenoxy)hexano]-N'-(p-octylthio)benzohydrazide, N-[11-(p-hydroxy-phenoxy)undecano]-N'-(6-hexylthio)hexanohydrazide, N-[11-(p-hydroxyphenoxy)undecano]-N'-(6-decylthio)hexanohydrazide, N-[11-(p-hydroxyphenoxy)undecano]-N'-(4-hexylthio)butanohydrazide, N-[11-(p-hydroxyphenoxy)undecano]-N'-(6-phenylthio)hexanohydrazide, N-[11-(3,4,5-trihydroxyphenoxy)undecano]-N'-(3-octadecylthio)propionohydrazide, N-[p-(p-hydroxyphenoxy)benzo]-N'-(3-hexylthio)hexanohydrazide, N-[p-(p-hydroxyphenoxymethyl)benzo]-N'-(3-octadecylthio)propionohydrazide, N-[2-(p-hydroxyphenoxy)ethyl]-N'-(3-tetradecylthio)propyloxamide, N-[3-(p-hydroxyphenoxy)propyl]-N'-(2-octadecylthio)ethyloxamide, N-[3-(3,4-dihydroxyphenoxy)propyl]-N'-(2-octadecylthio)ethyloxamide, N-[11-(p-hydroxyphenoxy)undecyl]-N'-(6-hexylthio)hexyloxamide, N-[p-(p-hydroxyphenoxy)phenyl]-N'-(2-octadecylthio)ethyloxamide, N-[2-(p-hydroxyphenoxy)acetyl]-N'-(3-dodecylthio)propylurea, N-[2-(p-hydroxyphenoxy)acetyl]-N'-(2-octadecylthio)ethylurea, N-[3-(p-hydroxyphenoxy)propionyl]-N'-(2-octadecylthio)ethylurea, N-[p-(p-hydroxyphenoxy)benzoyl]-N'-(2-octadecylthio)ethylurea, N-[2-(p-hydroxyphenoxy)ethyl]-N'-(6-octylthio)hexanoylurea, N-[2-(p-hydroxyphenoxy)ethyl]-N'-(4-hexylthio)butanoylurea, N-[p-(p-hydroxyphenoxy)phenyl]-N'-(3-octadecylthio)propylurea, 3-[3-(p-hydroxyphenoxy)propionyl]carbazinic acid-(2-octadecylthio)ethyl, 3-[11-(p-hydroxyphenoxy)undecanonyl]-carbazinic acid-(2-decylthio)ethyl, 4-[2-(p-hydroxyphenoxy)ethyl]-1-(3-tetradecylthio)propylsemicarbazide, 4-[2-(p-hydroxyphenoxy)ethyl]-1-(2-octadecylthio)ethylsemicarbazide, 4-[p-(p-hydroxyphenoxy)phenyl]-1-(2-tetradecylthio)ethylsemicarbazide, 1-[2-(p-hydroxyphenoxy)ethyl]-4-(2-tetradecylthio)ethylsemicarbazide, 1-[2-(p-hydroxyphenoxy)ethyl]-4-(2-octadecylthio)ethylsemicarbazide, 1-[p-(p-hydroxyphenoxy)phenyl]-4-(3-tetradecylthio)propylsemicarbazide, 1-[2-(p-hydroxyphenoxy)acetyl]-4-(3-tetradecylthio)propylsemicarbazide, 1-[3-(p-hydroxyphenoxy)propionyl]-4-(2-octadecylthio)

ethylsemicarbazide, 1-[11-(p-hydroxyphenoxy) undecanoyl]-4-(3-decylthio)propylsemicarbazide, 1-[p-(p-hydroxyphenoxy)benzoyl]-4-(2-octadecylthio) ethylsemicarbazide, 4-[2-(p-hydroxyphenoxy)ethyl]-1-(6-decylthio)hexanoylsemicarbazide, 4-[2-(p-hydroxyphenoxy)ethyl]-1-(4-hexylthio) butanoylsemicarbazide, 4-[p-(p-hydroxyphenoxy)phenyl]-1-(11-cyclohexylthio)undecanoylsemicarbazide, 1-[2-(p-hydroxyphenoxy)acetamido]-1-(4-dodecylthio) butanoylaminomethane, 1-[2-(p-hydroxyphenoxy) acetamido]-1-(3-octadecylthio)propanoylaminomethane, 1-[3-(p-hydroxyphenoxy)propanamido]-1-(3-octadecylthio) propanoylaminomethane, 1-[11-(p-hydroxyphenoxy) undecanamido]-N'-(4-decylthio)butanoylaminomethane, 1-[p-(p-hydroxyphenoxy)benzamido]-1-(3-octadecylthio) propanoylaminomethane, 1-[2-(p-hydroxyphenoxy) acetamido]-1-[N'-(6-decylthio)hexylureido]methane, 1-[2-(p-hydroxyphenoxy)acetamido]-1-[N'-(2-octadecylthio) ethylureido]methane, 1-[3-(p-hydroxyphenoxy) propanamido]-1-[N'-(3-octadecylthio)propylureido] methane, 1-[11-(p-hydroxyphenoxy)undecanamido]-1-[N'-(3-decylthio)propylureido]methane, 1-[p-(p-hydroxyphenoxy)benzamido]-1-[N'-(6-octylthio) hexylureido]methane, 1-{N'-[2-(p-hydroxyphenoxy)ethyl] ureido}-1-(2-octadecylthio)acetylaminomethane, 1-{N'-[p-(p-hydroxyphenoxy)phenyl]ureido}-1-(3-octadecylthio) propanoylaminomethane, N-[2-(p-hydroxyphenoxy)ethyl]-N'-(3-octadecylthio)propylmalonamide, N-[p-(p-hydroxyphenoxy)phenyl]-N'-(2-octadecylthio) ethylmalonamide, etc.

Finally, examples of the compound wherein m=1 and $X^2$=oxygen atom may include N-(10-dodecyloxy)decyl-2-(p-hydroxyphenoxy)acetamide, N-(2-octadecyloxy)ethyl-2-(p-hydroxyphenoxy)acetamide, N-(10-dodecyloxy)decyl-3-(p-hydroxyphenoxy)propanamide, N-(2-octadecyloxy) ethyl-3-(p-hydroxyphenoxy)propanamide, N-(3-octadecyloxy)propyl-6-(p-hydroxyphenoxy)hexanamide, N-(2-decyloxy)ethyl-11-(p-hydroxyphenoxy) undecanamide, N-(p-octyloxy)ethyl-6-(p-hydroxyphenoxy) hexanamide, N-(2-octadecyloxy)ethyl-p-(p-hydroxyphenoxy)benzamide, N-[11-(p-hydroxyphenoxy) undecyl]-6-hexyloxyhexanamide, N-[11-(p-hydroxyphenoxy)undecyl]-4-hexyloxybutanamide, N-[2-(p-hydroxyphenoxy)ethyl]-4-octadecyloxybutanamide, N-[6-(p-hydroxyphenoxy)hexyl]-6-decyloxyhexanamide, N-[p-(p-hydroxyphenoxy)phenyl]-3-octadecyloxypropionamide, N-[2-(p-hydroxyphenoxy)ethyl]-N'-(2-tetradecyloxy) ethylurea, N-[2-(p-hydroxyphenoxy)ethyl]-N'-(2-octadecyloxy)ethylurea, N-[2-(3,4-dihydroxyphenoxy) ethyl]-N'-(3-octadecyloxy)propylurea, N-[6-(p-hydroxyphenoxy)hexyl]-N'-(2-decyloxy)ethylurea, N-[p-(p-hydroxyphenoxy)phenyl]-N'-(2-octadecyloxy)ethylurea, N-[10-(p-hydroxyphenoxy)decyl]-N'-(6-hexyloxy) hexylurea, N-[10-(p-hydroxyphenoxy)ethyl]carbamic acid-(2-octadecyloxy)ethyl, N-[6-(p-hydroxyphenoxy)hexyl] carbamic acid-(3-tetradecyloxy)propyl, N-[p-(p-hydroxyphenoxy)phenyl]carbamic acid-(6-dodecyloxy) hexyl, N-(2-octadecyloxy)ethylcarbamic acid-[2-(p-hydroxyphenoxy)ethyl], N-(3-decyloxy)propylcarbamic acid-]11-(p-hydroxyphenoxy)undecyl], N-(3-tetradecyloxy) propylcarbamic acid-[p-(p-hydroxyphenoxy)phenyl], N-[3-(p-hydroxyphenoxy)propionyl]-N-(2-octadecyloxy) acetylamine, N-[6-(p-hydroxyphenoxy)hexanonyl]-N-(3-octadecyloxy)propionylamine, N-[3-(p-hydroxyphenoxy) propionyl]-N-(p-octyloxy)benzoylamine, N-[2-(p-hydroxyphenoxy)acet]-N'-(3-dodecyloxy) propionohydrazide, N-[2-(p-hydroxyphenoxy)acet]-N'-(2-octadecyloxy)acethydrazide, N-[3-(p-hydroxyphenoxy) propiono]-N'-(3-octadecyloxy)propionohydrazide, N-[3-(3,4-dihydroxyphenoxy)propiono]-N'-(3-octadecyloxy) propionohydrazide, N-[6-(p-hydroxyphenoxy)hexano]-N'-(6-tetradecyloxy)hexanohydrazide, N-[6-(p-hydroxyphenoxy)hexano]-N'-(3-octadecyloxy) propionohydrazide, N-[6-(p-hydroxyphenoxy)hexano]-N'-(p-octyloxy)benzohydrazide, N-[11-(p-hydroxyphenoxy) undecano]-N'-(6-hexyloxy)hexanohydrazide, N-[11-(p-hydroxyphenoxy)undecano]-N'-(6-decyloxy) hexanohydrazide, N-[11-(p-hydroxyphenoxy)undecano]-N'-(4-hexyloxy)butanohydrazide, N-[11-(p-hydroxyphenoxy) undecano]-N'-(6-phenyloxy)hexanohydrazide, N-[11-(3,4,5-trihydroxyphenoxy)undecano]-N'-(3-octadecyloxy) propionohydrazide, N-[p-(p-hydroxyphenoxy)benzo]-N'-(3-hexyloxy)hexanohydrazide, N-[p-(p-hydroxyphenoxyymethyl)benzo]-N'-(3-octadecyloxy) propionohydrazide, N-[2-(p-hydroxyphenoxy)ethyl]-N'-(3-tetradecyloxy)propyloxamide, N-[3-(p-hydroxyphenoxy) propyl]-N'-(2-octadecyloxy)ethyloxamide, N-[3-(3,4-dihydroxyphenoxy)propyl]-N'-(2-octadecyloxy) ethyloxamide, N-[11-(p-hydroxyphenoxy)undecyl]-N'-(6-hexyloxy)hexyloxamide, N-[p-(p-hydroxyphenoxy) phenyl]-N'-(2-octadecyloxy)ethyloxamide, N-[2-(p-hydroxyphenoxy)acetyl]-N'-(3-dodecyloxy)propylurea, N-[2-(p-hydroxyphenoxy)acetyl]-N'-(2-octadecyloxy) ethylurea, N-[3-(p-hydroxyphenoxy)propionyl]-N'-(2-octadecyloxy)ethylurea, N-[p-(p-hydroxyphenoxy) benzoyl]-N'-(2-octadecyloxy)ethylurea, N-[2-(p-hydroxyphenoxy)ethyl]-N'-(6-octyloxy)hexanoylurea, N-[2-(p-hydroxyphenoxy)ethyl]-N'-(4-hexyloxy) butanoylurea, N-[p-(p-hydroxyphenoxy)phenyl]-N'-(3-octadecyloxy)propanoylurea, 3-[3-(p-hydroxyphenoxy) propionyl]carbazinic acid-(2-octadecyloxy)ethyl, 3-[11-(p-hydroxyphenoxy)undecanonyl]carbazinic acid-(2-decyloxy)ethyl, 4-[2-(p-hydroxyphenoxy)ethyl]-1-(3-tetradecyloxy)propylsemicarbazide, 4-[2-(p-hydroxyphenoxy)ethyl]-1-(2-octadecyloxy) ethylsemicarbazide, 4-[p-(p-hydroxyphenoxy)phenyl]-1-(2-tetradecyloxy)ethylsemicarbazide, 1-[2-(p-hydroxyphenoxy)ethyl]-4-(2-tetradecyloxy) ethylsemicarbazide, 1-[2-(p-hydroxyphenoxy)ethyl]-4-(2-octadecyloxy)ethylsemicarbazide, 1-[p-(p-hydroxyphenoxy)phenyl]-4-(3-tetradecyloxy) propylsemicarbazide, 1-[2-(p-hydroxyphenoxy)acetyl]-4-(3-tetradecyloxy)propylsemicarbazide, 1-[3-(p-hydroxyphenoxy)propionyl]-4-(2-octadecyloxy) ethylsemicarbazide, 1-[11-(p-hydroxyphenoxy) undecanoyl]-4-(3-decyloxy)propylsemicarbazide, 1-[p-(p-hydroxyphenoxy)benzoyl]-4-(2-octadecyloxy) ethylsemicarbazide, 4-[2-(p-hydroxyphenoxy)ethyl]-1-(6-decyloxy)hexanoylsemicarbazide, 4-[2-(p-hydroxyphenoxy)ethyl]-1-(4-hexyloxy) butanoylsemicarbazide, 4-[p-(p-hydroxyphenoxy)phenyl]-1-(11-cyclohexyloxy)undecanoylsemicarbazide, 1-[2-(p-hydroxyphenoxy)acetamido]-1-(4-dodecyloxy) butanoylaminomethane, 1-[2-(p-hydroxyphenoxy) acetamido]-1-(3-octadecyloxy)propanoylaminomethane, 1-[3-(p-hydroxyphenoxy)propanamido]-1-(3-octadecyloxy) propanoylaminomethane, 1-[11-(p-hydroxyphenoxy) undecanamido]-N'-(4-decyloxy)butanoylaminomethane, 1-[p-(p-hydroxyphenoxy)benzamido]-1-(3-octadecyloxy) propanoylaminomethane, 1-[2-(p-hydroxyphenoxy) acetamido]-1-[N'-(6-decyloxy)hexylureido]methane, 1-[2-(p-hydroxyphenoxy)acetamido]-1-[N'-(2-octadecyloxy) ethylureido]methane, 1-[3-(p-hydroxyphenoxy) propanamido]-1-[N'-(3-octadecyloxy)propylureido]

methane, 1-[11-(p-hydroxyphenoxy)undecanamido]-1-[N'-(3-decyloxy)propylureido]methane, 1-[p-(p-hydroxyphenoxy)benzamido]-1-[N'-(6-octyloxy)hexylureido]methane, 1-{N'-[2-(p-hydroxyphenoxy)ethyl]ureido}-1-(2-octadecyloxy)acetylaminomethane, 1-{N'-[p-(p-hydroxyphenoxy)phenyl]ureido}-1-(3-octadecyloxy)propanoylaminomethane, N-[2-(p-hydroxyphenoxy)ethyl]-N'-(3-octadecyloxy)propylmalonamide, N-[p-(p-hydroxyphenoxy)phenyl]-N'-(2-octadecyloxy)ethylmalonamide, etc.

In the compound represented by the formula (II), A is a substituent having at least one nitrogen atom, preferably a non-cyclic amino group or a nitrogen atom-containing 5- or 6-membered heterocyclic ring. Examples of the heterocyclic ring may include, as a 5-membered ring, a pyrolidine ring, an imidazolidine ring, a thiazolidine ring, a pyrrole ring, an imidazole ring, a pyrazole ring and a thiazole ring, etc., and as a 6-membered ring, a piperidine ring, a morpholine ring, a thiomorpholine ring, a piperazine ring, a pyridine ring and a pyrimidine ring, etc., and the nitrogen atom in the ring may be directly bound to Ra or may not. Moreover, the above-mentioned non-cyclic amino group and the heterocyclic ring may be substituted by a lower alkyl group, an aralkyl group, an aryl group or a hydroxyl group. Also, Ra is specifically a divalent hydrocarbon group having 1 to 12 carbon atoms, preferably an alkylene group, and may contain at least on aromatic ring in said group or may be an aromatic ring alone. Rb is specifically a hydrocarbon group having 1 to 24 carbon atoms, and may contain an oxygen atom or a sulfur atom in the group. It is preferably a mere hydrocarbon group, or a group which contains a sulfur atom which can be easily synthesized.

Also, Xa represents a divalent group containing at least one —CONH— bond, and specific examples thereof may include an amide (—CONH—, —NHCO—), urethane (—NHCOO—, —OCONH—), diacylamine (—CONHCO—), diacylhydrazide (—CONHNHCO—), oxalic acid diamide (—NHCOCONH—), acyl urea (—CONHCONH—, —NHCONHCO—), 3-acylcarbazinic acid ester (—CONHNHCOO—), semicarbazide (—NHCONHNH—, —NHNHCONH—), acylsemicarbazide (—CONHNHCONH—, —NHCONHNHCO—), diacylaminomethane (—CONH $CH_2$NHCO—), 1-acylamino-1-ureidomethane (—CONH$CH_2$NHCONH—, —NHCONH$CH_2$NHCO—), malonamide (—NHCO$CH_2$CONH—), urea (—NH CONH—) and the like.

Specific examples of the compound represented by the formula (II) may include the following compounds.

First, as examples of the compound wherein A is a non-cyclic amino group, there may be mentioned N-(3-diethylaminopropyl)-11-decylthioundecanamide, N-(3-diethylaminopropyl)carbamic acid-11-dodecylthioundecyl ester, N-(2-octadecylthioethyl)carbamic acid-6-diethylaminohexyl ester, N-6-dimethylaminocaprono-N'-3-dodecylthiopropionohydrazide, 10-(dodecylthio)decylcarbamic acid-6-dicyclohexylaminocapril ester, 1-(3-diethylaminopropiono)-4-(10-decylthiodecyl)semicarbazide, N-4-aminocyclohexyl-N'-10-decylthiodecyloxamide, 1-(3-dimethylaminopropionylamino)-1-(11-dodecylthiodecanoylamino)methane, N-3-diethylaminopropyl N'-10-dodecylthiodecylurea, N-(3-diethylaminopropyl)octadecanamide, N-(3-diethylaminopropyl)carbamic acid-hexadecyl ester, N-tetradecylcarbamic acid-6-diethylaminohexyl ester, N-6-dimethylaminocaprono-N'-3-octadecanohydrazide, 1-(3-diethylaminopropiono)-4-octadecylsemicarbazide, N-4-aminocyclohexyl-N'-hexadecyloxamide, 1-(3-dimethylaminopropionylamino)-1-octacecanoylamino methane, N-3-diethylaminopropyl-N'-octadecylurea, etc.

Next, examples of the compound wherein A is a heterocyclic ring may include N-octadecylcarbamic acid-2-(1-pyrolidinyl)ethyl ester, N-3-pyrolidinylpropiono-N'-octacedanohyrazide, N-5-1H-tetrazolyl-N'-10-decylthiodecylurea, N-[1-(4-methylpiperazino)]-N'-octadecylurea, N-2-thiazolyl-N'-10-dodecylthiodecyloxamide, 1-(11-dodecylthioundecano)-4-(2-thiazolinyl)semicarbazide, N-piperidinocarbamic acid-6-octadecylthiohexyl ester, N-[2-(1-piperidino)ethyl]-11-cyclohexylthioundecanamide, N-(10-decylthiodecyl)carbamic acid-2-(1-piperidino)ethyl ester, N-[2-(1-piperidino)propiono]-N'-3-dodecylthiopropionohydrazide, 1-[3-(1-piperidino)propiono]-4-(10-decylthiodecyl)semicarbazide, N-[11-(1-piperidino)undecano]-N'-3-dodecylthiopropionohydrazide, N-(4-piperidinyl)carbo-N'-11-dodecylthioundecanohydrazide, 1-[4-(1-methyl)piperidinylcarbo]-4-(10-dodecylthiodecyl)semicarbazide, N-[2-(4-hydroxy-1-piperidinyl)ethyl]-11-dodecylthoiundecanamide, N-(2-morpholinoethyl)-11-decylthioundecanamide, N-(10-dodecylthiodecyl)carbamic acid-6-morpholinohexyl ester, N-10-decylthiodecylcarbamic acid-2-morpholinoethyl ester, N-11-morpholinoundecano-N'-3-cyclohexylthiopropionohydrazide, N-3-morpholinopropyl-N'-10-decylthiodecyloxamide, N-11-dodecylthioundecyloxycarbo-N'-3-morpholinopropionohydrazide, N-(3-morpholinopropyl)-3-dodecylthiopropanamide, 1-(3-morpholinopropionylamino)-1-(11-decylthiopropionylamino)methane, N-2-morpholinoethyl-N'-10-decylthiodecylmalonamide, etc.

In the compound represented by the formula (III), Rc and Rd each represent a hydrocarbon group having 1 to 24 carbon atoms, which may be the same or different from each other. Also, Re is a divalent hydrocarbon group having 1 to 12 carbon atoms, preferably an alkylene group and it may contain an aromatic ring in the group or it may comprise only an aromatic ring. Rf represents a hydrocarbon group having 1 to 28 carbon atoms, preferably an aliphatic hydrocarbon group. Also, when Rf includes an oxygen atom or a sulfur atom in the group, Rf is represented by —Rf1—O—) Rf2 or —Rf1—S—Rf2 wherein Rf1 and Rf2 represent an alkylene group and an alkyl group, respectively, and the total carbon atoms of the both groups are 2 to 28. Moreover, it is particularly preferred that the total carbon atoms of Rc, Rd, Re and Rf (including Rf1 and Rf2) are 18 to 64.

Also, Xb represents a divalent group having at least one —CONH— bond, and specific examples thereof may include an amide (—CONH—, —NHCO—), urea (—NHCONH—), urethane (—NHCOO—, —OCONH—), diacylamine (—CONHCO—), diacylhydrazide (—CONH— NHCO—), oxalic acid diamide (—NHCOCONH—), acyl urea (—CONH— CONH—, —NHCONHCO—), 3-acylcarbazinic acid ester (—CONHNH— COO—), semicarbazide (—NHCONHNH—, —NHNHCONH—), acylsemicarbazide (—CONHNHCONH—, —NHCONHNHCO—), diacylaminomethane (—CONH$CH_2$NHCO—), 1-acylamino-1-ureidomethane (—CONH$CH_2$NHCO—NH—, —NHCONH$CH_2$NHCO—), malonamide (—NHCO$CH_2$CONH—) and the like. Moreover, when Xb represents urea, urethane or diacylhydrazide, it is particularly preferred since it can be prepared inexpensive.

Specific examples of the compound represented by the formula (III) may include the following compounds but the present invention is not limited by these.

N-[3-(dimethoxyphosphoryl)propyl]octadecanamide, N-tetradecyl-3-(diethoxyphosphoryl)propanamide, N-[2-(dimethoxyphosphoryl)ethyl]-N'-tetradecylurea, N-[3-(diethoxyphosphoryl)propyl]-N'-octadecylurea, N-[3-(dibutoxyphosphoryl)propyl]-N'-octadecylurea, N-[p-(dibutoxyphosphoryl)phenyl]-N'-dococylurea, N-[3-(diethoxyphosphoryl)propyl]-N'-(10-decyloxydecyl)urea, hexadecyl N-[3-(dimethoxyphosphoryl)propyl]carbamidate, hexadecyl N-[3-(diethoxyphosphoryl)propyl]carbamidate, [3-(diethoxyphosphoryl)propyl]N-octadecylcarbamidate, [3-(diethoxyphosphoryl)propyl]N-(3-octadecylthiopropyl) carbamidate, N-octadecanoyl-3-(diethoxyphosphoryl) propanamide, N-[3-(dimethoxyphosphoryl)propiono]-N'-octadecanohydrazide, N-[3-(diethoxyphosphoryl) propiono]-N'-octadecanohydrazide, N-[11-(diethoxyphosphoryl)undecano]-N'-octanohydrazide, N-[3-(dibutoxyphosphoryl)propiono]-N'-tetradecanohydrazide, N-[3-(dioctyloxyphosphoryl)propiono]-N'-decanohydrazide, N-[3-(didodecyloxyphosphoryl) propiono]-N'-octanohydrazide, N-[p-(diethoxyphosphoryl) benzo]-N'-docosanohydrazide, N-[3-(diethoxyphosphoryl) propiono]-N'-(11-decylthioundecano)hydrazide, N-[3-(diethoxyphosphoryl)propionyl]-N'-octadecyloxamide, N-[3-(dibutoxyphosphoryl)propionyl]-N'-octadecyloxamide, N-[3-(diethoxyphosphoryl)propionyl]-N'-octadecylurea, N-[3-(diethoxyphosphoryl)propyl]-N'-octadecanoylurea, N-carbohexadecyloxy-N'-[3-(diethoxyphosphoryl)propiono]hydrazide, 1-tetradecyl-4-[3-(diethoxyphosphoryl)propyl]semicarbazide, 1-[3-(diethoxyphosphoryl)propiono]-4-octadecylsemicarbazide, 1-[11-(dibutoxyphosphoryl)undecano]-4-octadecylsemicarbazide, 1-[3-(diethoxyphosphoryl) propionylamino]-1-octadecanoylaminomethane, 1-[3-(dibutoxyphosphoryl)propionylamino]-1-(N'-octadeylureido)methane, N-[3-(diethoxyphosphoryl) propionyl]-N'-octadecylmalonamide, etc.

In the compound represented by the formula (IV), Rg and Ri each represent a hydrocarbon group having 1 to 24 carbon atoms. Rh represents a divalent hydrocarbon group having 1 to 12 carbon atoms, preferably an alkylene group, and may contain an aromatic ring in the group or may comprise an aromatic ring alone. The total carbon atoms of Rg, Rh and Ri are preferably 20 to 40. Also, Xc represents a divalent group having at least one —CONH— bond, and specific examples thereof may include an amide (—CONH—, —NHCO—), urea (—NHCONH—), urethane (—NHCOO—, —OCONH—), diacylamine (—CONHCO—), diacylhydrazide (—CONHNHCO—), oxalic acid diamide (—NHCOCONH—), acyl urea (—CONHCONH—, —NHCONHCO—), 3-acylcarbazinic acid ester (—CONHNHCOO—), semicarbazide (—NHCONHNH—, —NHNHCONH—), acylsemicarbazide (—CONHNHCONH—, —NHCONHNHCO—), diacylaminomethane (—$CONHCH_2NHCO$—), 1-acylamino-1-ureidomethane (—$CONHCH_2NHCONH$—, —$NHCONHCH_2NHCO$—), malonamide (—$NHCOCH_2CONH$—) and the like.

Examples of the compound represented by the formula (IV) may include the following compounds but the present invention is not limited by these.

N-[2-(propylsulfinylethyl)]octadecanamide, N-hexadecyl [2-(propylsulfinylethan)]amide, N-[3-(methylsulfinyl) propyl]-N'-octacecylurea, N-[2-(octylsulfinyl)ethyl]-N'-decylurea, hexadecyl N-[2-(methylsulfinyl)ethyl] carbamidate, [4-(methylsulfinyl)butyl]N-hexadecylcarbamidate, N-[2-(propylsulfinyl)acetyl] octadecanamide, N-[3-(methylsulfinyl)propionyl]-N'-octadecanohydrazide, N-[4-(hexylsulfinyl)butyryl]-N'-dodecanohydrazide, N-[3-(methylsulfinyl)propionyl]-N'-octadecyloxamide, N-[p-(decylsulfinyl)phenyl]-N'-octadecyloxamide, N-[11-(methylsulfinyl)undecanoyl]-N'-decylurea, N-hexadecanoyl-N'-[3-(butylsulfinyl)propyl] urea, hexadecyl 3-[3-(methylsulfinyl)propionyl]-carbazinate, 1-[2-(decylsulfinyl)acetyl]-4-octadecylsemicarbazide, 1-dodecano-4-[3-dodecylsulfinyl) propyl]-semicarbazide, 1-[3-(ethylsulfinyl) propionylamino]-1-octadecanoylaminomethane, 1-[p-(butylsulfinyl)benzoylamino]-1-octadecanoylaminomethane, 1-[p-(butylsulfinyl) benzoylamino]-1-(N'-octadecylureido)methane, N-[2-(propylsulfinyl)ethyl]-N'-octadecylmalondiamide, etc.

In the compound represented by the formula (V), i is an integer of 1 to 3, preferably a compound wherein i is 1 or 2, i.e., it is a 5- or 6-membered ring-forming compound. Rj represents a divalent hydrocarbon group having 1 to 12 carbon atoms, preferably an alkylene group, and the group may contain an aromatic ring or may comprise only an aromatic ring. j represents the presence or absence of a sulfur atom.

Examples of the compound represented by the formula (V) may include the following compounds but the present invention is not limited by these.

N-tetradecylsuccinimide, N-hexadecylsuccinimide, octadecylsuccinimide, N-docosylsuccinimide, N-dodecylglutarimide, N-(4-heptylphenyl)glutarimide, N-tetradecylglutarimide, N-hexadecylglutarimide, N-octadecylglutarimide, N-docosylglutarimide, N-dodecyladipinimide, N-octadecyladipinimide, N-(2-decylthio)ethylsuccinimide, N-(2-dodecylthio) ethylsuccinimide, N-(2-octadecylthio)ethylsuccinimide, N-(3-decylthio)propylsuccinimide, N-(3-dodecylthio) propylsuccinimide, N-(3-octadecylthio)propylsuccinimide, N-(5-octylthio)pentylsuccinimide, N-(5-decylthio) pentylsuccinimide, N-(5-dodecylthio)pentylsuccinimide, N-(5-octadecylthio)pentylsuccinimide, N-(10-octylthio) decylsuccinimide, N-(10-decylthio)decylsuccinimide, N-(10-dodecylthio)decylsuccinimide, N-(10-octadecylthio) decylsuccinimide, N-(4-decylthio)phenylsuccinimide, N-(4-dodecylthio)phenylsuccinimide, N-(4-octadecylthio) phenylsuccinimide, N-(2-cyclohexylthio)ethylsuccinimide, N-(3-cyclohexylthio)propylsuccinimide, N-(5-cyclohexylthio)pentylsuccinimide, N-(10-cyclohexylthio) decylsuccinimide, N-(4-cyclohexylthio)phenylsuccinimide, N-(2-decylthio)ethylglutarimide, N-(2-dodecylthio) ethylglutarimide, N-(2-octadecylthio)ethylglutarimide, N-(3-decylthio)propylglutarimide, N-(3-dodecylthio) propylglutarimide, N-(3-octadecylthio)propylglutarimide, N-(5-octylthio)pentylglutarimide, N-(5-decylthio) pentylglutarimide, N-(5-dodecylthio)pentylglutarimide, N-(5-octadecylthio)pentylglutarimide, N-(10-octylthio) decylglutarimide, N-(10-decylthio)decylglutarimide, N-(10-dodecylthio)decylglutarimide, N-(10-octadecylthio) decylglutarimide, N-(4-decylthio)phenylglutarimide, N-(4-dodecylthio)phenylglutarimide, N-(4-octadecylthio) phenylglutarimide, N-(2-cyclohexylthio)ethylglutarimide, N-(3-cyclohexylthio)propylglutarimide, N-(5-cyclohexylthio)pentylglutarimide, N-(10-cyclohexylthio) decylglutarimide, N-(4-cyclohexylthio)phenylglutarimide, N-(2-decylthio)ethyladipinimide, N-(2-dodecylthio) ethyladipinimide, N-(2-octadecylthio)ethyladipinimide, N-(3-decylthio)propyladipinimide, N-(3-dodecylthio)

propyladipinimide, N-(3-octadecylthio)propyladipinimide, N-(5-octylthio)pentyladipinimide, N-(5-decylthio) pentyladipinimide, N-(5-dodecylthio)pentyladipinimide, N-(5-octadecylthio)pentyladipinimide, N-(10-octylthio) decyladipinimide, N-(10-decylthio)decyladipinimide, N-(10-dodecylthio)decyladipinimide, N-(10-octadecylthio) decyladipinimide, N-(4-decylthio)phenyladipinimide, N-(4-dodecylthio)phenyladipinimide, N-(4-octadecylthio) phenyladipinimide, N-(2-cyclohexylthio)ethyladipinimide, N-(3-cyclohexylthio)propyladipinimide, N-(5-cyclohexylthio)pentyladipinimide, N-(10-cyclohexylthio) decyladipinimide, N-(4-cyclohexylthio)phenyladipinimide, etc.

In the compound represented by the formula (VI), Xd represents a monovalent group having at least one —CONH— bond, and specific examples thereof may include an amide (—$CONH_2$), urea (—$NHCONH_2$), urethane (—$OCONH_2$), acylhydrazide (—$CONHNH_2$), oxalic acid diamide (—$NHCOCONH_2$), acyl urea (—$CONHCONH_2$), carbadinic acid ester (—$OCONHNH_2$), semicarbazide (—$NHCONHNH_2$), 1-acylsemicarbazide (—$CONHNHCONH_2$), 1-acylamino-1-ureidomethane (—$CONHCH_2NHCONH_2$), malonamide (—$NHCOCH_2CONH_2$) and the like. However, when k=0, Xd does not contain mere amide (—$CONH_2$). Rm represents a divalent hydrocarbon group having 1 to 12 carbon atoms, preferably an alkylene group, and may contain an aromatic ring in the group or may comprise only an aromatic ring. Also, when k=0, it is particularly preferred that the case where the carbon number of Rl is 12 or more, and when k=1, it is particularly preferred that the case where the total carbon number of Rl and Rm is 16 to 30.

Examples of the compound represented by the formula (VI) may include the following compounds but the present invention is not limited by these.

First, examples of the compound wherein k=0, there may be mentioned octadecanohydrazide, docosanohydrazide, octadecylurea, hexadecylurea, dodecylurea, hexadecyl carbamidinate, dodecyl carbamidinate, N-octadecanourea, N-tetradecanourea, hexadecyl carbamizinate, docosyl carbimizinate, N-octadecyloxamide, N-dodecyloxamide, 4-octadecylsemicarbazide, 4-hexadecylsemicarbazide, 1-tetradecanosemicarbazide, 1-octadecanosemicarbazide, 1-docosanosemicarbazide, 3-(octadecylamino) oxalylhydrazine, 3-(tetradecylamino)oxalylhydrazine, 1-(octadecylaminocarbonyl)semicarbazide, 1-(hexadecylaminocarbonyl)semicarbazide, N-octadecylmalondiamide, N-docosylmalondiamide, 1-octadecanoamino-1-ureidomethane, 1-hexadecanoamino-1-ureidomethane, etc.

Next, examples of the compound wherein k=1, there may be mentioned 3-(octadecylthio)propionamide, 11-(decylthio)undecanamide, 6-(tetradecylthio)hexanamide, 11-(octadecylthio)undecanamide, 2-(hexadecylthio) acetamide, 3-(docosylthio)propionohydrazide, 11-(octadecylthio)undecanohydrazide, 6-(dodecylthio) hexanohydrazide, N-[2-(octadecylthio)ethyl]urea, N-[2-(tetradecylthio)ethyl]urea, N-[2-(hexadecylthio)ethyl] oxamide, N-[4-(dodecylthio)butyl]oxamide, [1-(octylthio) decyl]carbamidate, [12-(undecylthio)dodecyl]) carbamidate, [10-(hexylthio)decyl]carbadinate, [4-(docosylthio)butyl]carbadinate, 4-[3-(octadecylthio)propyl] semicarbazide, 4-[3-(decylthio)decyl]semicarbazide, 1-[6-(dodecylthio)hexano]semicarbazide, 1-[4-(hexadecylthio) butano]semicarbazide, 1-[3-(tetradecylthio) propionylamino]-ureide, 1-[8-(tetradecylthio) octanoylamino]ureide, N-[11-(docosylthio)undecanonyl] malonamide, N-[3-(hexadecylthio)propionyl]malonamide, p-(octadecylthio)benzamide, p-[(hexadecylthio)methyl] benzamide, p-(tetradecylthio)benzhydrazide, p-(octadecylthio)phenylacethydrazide, etc.

In the compound represented by the formula (VII), Q preferably represents a 5- or 6-membered heteroaromatic ring, and specific examples thereof may include, as a 5-membered ring, a pyrazole ring, an imidazole ring, a triazole ring, an oxazole ring, a thiazole ring, and a thiadiazole ring, etc., and as a 6-membered ring, a pyridine ring, a pyrimidine ring, a pyrazine ring, and a triazine ring, etc. Moreover, the above-mentioned aromatic ring may be substituted by a lower alkyl group, an aralkyl group, or an aryl group, or may form a condensed ring such as an indole ring. Also, Rn represents a monovalent or divalent hydrocarbon group having 6 to 24 carbon atoms, preferably an alkylene group having 8 to 24 carbon atoms, and may include an ether bond or a sulfide bond in the group. Y represents a counter anion and examples thereof may include a halogen, a substituted sulfonate, a substituted borate, a substituted phosphate, etc.

Examples of the compound represented by the formula (VII) may include the following compounds but the present invention is not limited by these.

First, as examples of the compound wherein Rn is a monovalent alkylene, Q is a 5-membered heterocyclic aromatic ring or a fused ring, there may be mentioned 1-methyl-2-tetradecylpyrazolium tosylate, 1-methyl-2-octadecylpyrazolium iodide, 1-(11-decylthioundecyl)-2-ethylpyrazolium bromide, 1-hexadecyl-2,5-dimethylpyrazolium methanesulfonate, 1-methyl-3-octadecylimidazolium prechlorate, 1-methyl-3-octadecylimidazolium tosylate, 1-methyl-3-octadecylimidazolium tetrafluoroborate, 1,3-dioctylimidazolium chloride, 1-cyclohexyl-3-octylimidazolium chloride, 1-(11-decylthioundecyl)-3-phenylimidazolium bromide, 1-phenyl-4-octadecyl-1,2,4-triazolium tosylate, 1-(2,4,6-trimethylphenyl)-4-cyclohexylmethyl-1,2,4-triazolium tosylate, 3-octadecyloxazolium chloride, 2-phenyl-3-octadecyloxazolium tosylate, 3-docosylbenzoxazolium hexafluorophosphate, 3-(11-cyclohexylthioundecyl) thiazolium bromide, 3-octadecylthiazolium bromide, 3-octadecylthiazolium perchlorate, 2-methyl-3-octadecylbenzothiazole iodide, etc.

Next, examples of a compound wherein Rn is a monovalent alkylene group and Q is a 6-membered heterocyclic aromatic ring may include 1-cyclohexylmethylpyridinium bromide, 1-octadecylpyridinium tosylate, 1-hexadecylpyridinium tosylate, 1-hexadecylpyridinium chloride, 1-octadecylpyridinium bromide, 1-hexadecylpyridinium iodide, 1-hexadecylpyridinium perchlorate, 1-hexadecylpyridinium tetrafluoroborate, 1-hexadecylpyridinium hexafluorophosphate, 1-(11-cyclohexylthioundecyl)pyridinium tosylate, 1-docosyl-4-methoxypyridinium tosylate, 1-octadecyl-2,4,6-trimethylpyrimidinium iodide, 1-octadecylpyradinium tosylate, 1-octadecyl-2-methylpyradinium tosylate, 1-tetradecyl-1,3,5-triazinium iodide, etc.

Finally, examples of a compound wherein Rn is a divalent alkylene group may include 1,10-bis(3-dimethylimidazolium)-decane dibromide, 1,12-bis(1-oxazolium)dodecane dibromide, 1,12-bis(1-thiazolium) dodecane diperchlorate, 1,12-(1-pyridinium)dodecane dibromide, 1,12-(1-pyridinium)dodecane dihexafluorophosphate, bis-11-(1-pyridinium) undecylthioether ditosylate, etc.

In the compound represented by the formula (VIII), at least one of Ro to Rr preferably has a long chain alkyl group having 10 to 24 carbon atoms. Also, $Z^-$ is anion, and preferably a halogen, a sulfonic acid anion, a substituted borate, a substituted phosphate, a substituted arsenate, or a substituted antimonate.

Examples of the compound represented by the formula (VIII) may include the following compounds but the present invention is not limited by these.

There may be mentioned hexadecyltriphenylphosphonium bromide, hexadecyltriphenylphosphonium tetraphenylborate, tetramethylphosphonium tetraphenylborate, 4-pyridyltriphenylphosphonium trifluoromethanesulfonate, 4-(2-benzoyl) pyridyltributylphosphonium trifluoromethanesulfonate, benzyltributylphosphonium chloride, etc.

In the compound represented by the formula (IX), at least one of Ro to Rr preferably has a long chain alkyl group having 10 to 24 carbon atoms. Also, $E^-$ is anion, and preferably a halogen, a sulfonic acid anion, a substituted borate, a substituted phosphate, a substituted arsenate, or a substituted antimonate.

Examples of the compound represented by the formula (IX) may include the following compounds but the present invention is not limited by these.

There may be mentioned dimethyloctadecylsulfonium iodide, p-methoxyphenylbenzylmethylsulfonium hexafluoroantimonate, isopropyldiphenylsulfonium tetrafluoroborate, allyldiphenylsulfonium tetrafluoroborate, etc.

The reversible color developing agent represented by the formula (I) of the present invention may be used singly or in combination of two or more. An amount of the compound based on the dye precursor which is usually colorless or a pale color is generally 5 to 5000% by weight, preferably 10 to 3000% by weight.

An amount of the compound represented by the formula (II), (III), (IV), (V), (VI), (VII), (VIII) or (IX) based on the reversible color developing agent is preferably 0.1 to 1000% by weight, more preferably 0.5 to 200% by weight, particularly preferably 1 to 100% by weight in view of heat resistant preservability of the printed image. Also, the compound represented by the formula (II), (III), (IV), (V), (VI), (VII), (VIII) or (IX) may be used singly or in combination of two or more selected from the same or different formulae.

The electro-donative dye precursor which is usually colorless or a pale color to be used in the present invention include those generally known in a pressure-sensitive recording paper or a heat-sensitive recording paper, but is not particularly limited by these materials. Specific examples may include those as mentioned below but the present invention is not limited by these.

(1) Triarylmethane Type Compounds 3,3-Bis(p-dimethylaminophenyl)-6-dimethylaminophthalide (Crystal violet lactone), 3,3-bis(p-dimethylaminophenyl)phthalide, 3-(p-dimethylaminophenyl)-3-(1,2-dimethylindol-3-yl) phthalide, 3-(p-dimethylaminophenyl)-3-(2-methylindol-3-yl)phthalide, 3-(p-dimethylaminophenyl)-3-(2-phenylindol-3-yl)phthalide, 3-(4-diethylamino-2-ethoxyphenyl)-3-(1-ethyl-2-methylindol-3-yl)phthalide, 3-(4-diethylamino-2-ethoxyphenyl)-3-(1-ethyl-2-methylindol-3-yl)-4-azaphthalide, 3-(4-diethylamino-2-ethoxyphenyl)-3-(1-ethyl-2-methylindol-3-yl)-4,7-diazaphthalide, 3-(4-diethylamino-2-ethoxyphenyl)-3-(1-ethyl-2-methylindol-3-yl)-7-azaphthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3-p-dimethylaminophenyl-3-(1-methylpyrrol-2-yl)-6-dimethylaminophthalide, 3,3-bis (p-dimethylaminophenyl)-4-azaphthalide, etc.

(2) Diphenylmethane Type Compounds 4,4'-Bis(dimethylaminophenyl)benzhydrylbenzyl ether, N-chlorophenyl leucoauramin, N-2,4,5-trichlorophenyl leucoauramin, etc.

(3) Xanthene Type Compounds

Rhodamin B anilinolactam, Rhodamin B-p-chloroanilinolactam, 3-diethylamino-7-dibenzylaminofluoran, 3-diethylamino-7-octylaminofluoran, 3-diethylamino-7-phenylfluoran, 3-diethylamino-7-phenoxyfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-phenethylfluoran, 3-diethylamino-7-(4-nitroanilino)fluoran, 3-dibutylamino-6-methyl-7-anilinofluoran, 3-(N-methyl-N-propyl)amino-6-methyl-7-anilinofluoran, 3-(N-ethyl-N-isoamyl)amino-6-methyl-7-anilinofluoran, 3-(N-methyl-N-cyclohexyl)amino-6-methyl-7-anilinofluoran, 3-(N-ethyl-N-tetrahydrofuryl) amino-6-methyl-7-anilinofluoran, etc.

(4) Thiazine Type Compounds

Benzoylleucomethylene blue, p-nitrobenzoylleucomethylene blue, etc.

(5) Spiro Type Compounds

3-Methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, etc.

The normally colorless or slightly colored dye precursors may be used each alone or in combination of two or more.

As a specific method for preparing the reversible heat-sensitive recording material of the present invention, there may be mentioned a method in which the dye precursor and the reversible color developing agent of the present invention are mixed as main components and adding a decolorization promoting agent according to the present invention to the above mixture, if necessary, and coating the composition on a support to prepare a reversible heat-sensitive recording layer.

As a method for preparing a coating solution to contain the dye precursor, reversible color developing agent and decolorization promoting agent, there may be mentioned a method in which the respective compounds are dissolved in a solvent or dispersed in a dispersant, respectively, and then mixing these solutions and/or dispersions; a method in which the respective compounds are mixed and then dissolved in a solvent or dispersed in a dispersant; and a method in which the respective compounds are heated, melted and uniformized, and then cooled and dissolved in a solvent or dispersed in a dispersant, but the present invention is not limited by these methods. At the time of dispersion, a dispersing aid may be used, if necessary. As a dispersing aid when water is used as a dispersant, a water-soluble polymer such as a polyvinyl alcohol, etc., or various kinds of surfactants may be utilized. In the case of aqueous dispersion, a water-soluble organic solvent such as ethanol, etc., may be mixed. In addition, when an organic solvent such as hydrocarbons is used as a dispersant, lecithin or phosphates may be used as a dispersing aid.

Also, in order to improve strength of the reversible heat-sensitive recording layer, a binder may be added to the reversible heat-sensitive recording layer. Examples of the binder may include water-soluble polymers such as starches, hydroxyethyl cellulose, methyl cellulose, carboxymethyl cellulose, gelatin, casein, polyvinyl alcohol, modified polyvinyl alcohol, sodium polyacrylate, acrylamide/acrylate copolymer, acrylamide/acrylate/methacrylate terpolymer, an alkali salt of a styrene/maleic anhydride copolymer, an alkali salt of an ethylene/maleic anhydride copolymer; latexes such as polyvinyl chloride, polyurethane, polyacrylate, styrene/butadiene copolymer, acrylonitrile/butadiene copolymer, methyl acrylate/butadiene copolymer, ethylene/vinyl acetate copolymer, ethylene/vinyl chloride copolymer, polyvinyl chloride, ethylene/vinylidene chloride copolymer, polyvinylidene chloride, etc. A role of these binders is to maintain the state in which the respective materials of the composition are uniformly dispersed without localization by applying heat for printing and erasing an image or letter. Accordingly, it is preferred to use a resin having high thermal resistance as a binder resin. In recent years, a high value added reversible heat-sensitive recording material has frequently been used and accompanied thereby, a highly durable product having high thermal resistance, high water resistance, and further high adhesiveness has been required. For such a demand, a curable resin is particularly preferred.

Examples of the curable resin may include, for example, a thermosetting resin, an electron beam curable resin, an ultraviolet ray curable resin, etc. As the thermosetting resin, there may be mentioned, for example, a resin in which a hydroxyl group or a carboxyl group is reacted with a crosslinking agent and cured, such as a phenoxy resin, a polyvinyl butyral resin, a cellulose acetate propionate resin, etc. As the crosslinking agent at this time, there may be mentioned, for example an isocyanate compound, an amine compound, a phenol compound, an epoxy compound, etc.

As the monomer to be used for curing by an electron beam and ultraviolet rays, there may be mentioned a monofunctional monomer, a di-functional monomer, a polyfunctional monomer represented by an acrylic monomer. Particularly when an ultraviolet ray crosslinking is carried out, a photopolymerization initiator or a photo-polymerization promoter is used.

Also, for controlling a color formation sensitivity and decolorizing temperature of the reversible heat-sensitive recording layer, a heat meltable substance having a melting point of 60° C. to 200° C., preferably 80° C. to 180° C. may be contained in the reversible heat-sensitive recording layer as an additive. Sensitizers used for the general heat-sensitive recording paper can also be used. Examples of the heat meltable substances include waxes such as N-hydroxymethylstearamide, behenamide, stearamide and palmitamide; naphthol derivatives such as 2-benzyloxynaphthalene; biphenyl derivatives such as p-benzylbiphenyl and 4-allyloxybiphenyl; polyether compounds such as 1,2-bis(3-methylphenoxy)ethane, 2,2'-bis(4-methoxyphenoxy)diethyl ether and bis(4-methoxyphenyl) ether; and carbonic acid or oxalic acid diester derivatives such as diphenyl carbonate, dibenzyl oxalate and bis(p-methylbenzyl)oxalate. These materials may be used each alone or in combination of two or more.

As the support to be used for the reversible heat-sensitive recording layer of the present invention, there may be optionally used paper; coated paper; various nonwoven fabrics, woven fabrics; synthetic resin films such as polyethylene terephthalate or polypropylene; laminated paper of synthetic resins such as polyethylene, polypropylene, etc.; synthetic papers, metallic foils, glasses and composite sheets comprising the combination of these materials. The present invention is not limited by these, and these materials may be either of opaque, semi-transparent or transparent. Also, in order to make the background color white or any other specific color, a white pigment, a colored dye or pigment, or foam may be contained in the support or the surface thereof. Particularly when an aqueous coating is carried out on a support such as a film, etc., and when the surface of the support has low hydrophilicity and it is difficult to coat a composition for the reversible heat-sensitive recording layer, the surface of the support may be subjected to corona discharge treatment to make the surface hydrophilic or to coat a water-soluble polymer which is the same as a binder on the surface of the support to make easy adhesion.

In the layer structure of the reversible heat-sensitive recording layer of the present invention, it may comprise a reversible heat-sensitive recording layer alone. Also, in order to improve characteristics as the recording medium, depending on necessity, a protective layer may be provided on the reversible heat-sensitive recording layer; an undercoat layer containing a polymer, or at least one of white colored or colored dyes or pigments, or hollow particles may be provided between the reversible heat-sensitive recording layer and the support to heighten adhesiveness; or an intermediate layer may be provided between the protective layer and the recording layer to prevent deterioration of the recording layer or prevent from sinking the additive in the protective layer. In this case, the protective layer and/or the intermediate layer may be constituted by a plural number of layers of two layers or three or more layers. The reversible heat-sensitive recording layer may be constituted by a plural number of layers of two or more by adding the respective components to the respective layers or by changing the compositional ratio in the respective layers.

Also, a backcoat layer may be provided on the side reverse to the side on which the reversible heat-sensitive recording layer is provided, for blocking prevention, curling inhibition and antistatic purposes. Moreover, a recording layer containing a material in which information is electrically, magnetically or optically recordable therein may be provided on the side at which the reversible heat-sensitive recording layer, or a layer other than the heat-sensitive recording layer and/or on the heat-sensitive recording layer is provided, or an opposite side thereof.

A method for laminating the respective layers constituting the reversible heat-sensitive recording material of the present invention on the support is not particularly limited, and the layers can be formed by the conventionally known method. For example, it may be used various coating apparatuses such as air knife coater, blade coater, bar coater, curtain coater, etc., various kinds of printing machines by the system of lithographic, relief, intaglio, flexographic, gravure, screen or hot melt, etc. Further, in addition to the usual drying procedure, respective layers can be retained by ultraviolet (UV) irradiation or electron-beam (EB) irradiation.

The reversible heat-sensitive recording layer can be obtained by a method in which the respective dispersions obtained by finely pulverizing the respective components are mixed and coated on the support followed by drying; a method in which the respective solutions obtained by dissolving the respective components in a solvent are mixed and coated on the support followed by drying, etc. The drying conditions vary depending on the dispersant or solvent such as water, etc. In addition, there is a method in which the respective components are mixed and the components which can be melted are melted, and the melted materials are subjected to hot coating.

Also, in the reversible heat-sensitive recording layer, the protective layer and intermediate layer, there may be added pigments or others such as diatomaceous earth, talc, kaolin, backed kaolin, calcium carbonate, magnesium carbonate, titanium oxide, zinc oxide, silicon dioxide, aluminum hydroxide, urea-formalin resin, etc.; and a higher aliphatic acid metal salt such as zinc stearate, calcium stearate, etc., or waxes such as paraffin, oxidated paraffin, polyethylene, polyethylene oxide, stearic amide, castor wax, etc. to prevent from wearing head or sticking; a dispersing aid such as sodium dioctylsulfosuccinate, etc.; and a surfactant, fluorescent dye, ultraviolet rays absorber, etc.

Next, a method of forming a color and erasing a color of the reversible heat-sensitive recording material of the present invention is described. The color formation can be brought about when a rapid cooling occurs subsequent to the heating and it is possible by heating using, for example a thermal head, a laser beam light, etc. Also, the decolorization can occur when the cooling rate after the heating is slow. It can be carried out by using light sources such as thermal head, hot roll, hot stamping, high frequency heating, hot air, electrical heater, radiant heat from a light source such as tungsten lamp or halogen lamp, hot air or the like.

The principle of the image forming and erasing of the reversible heat-sensitive recording material of the present invention is not yet clear, but the following can be expected. A dye precursor which is generally colorless or pale color is heated with an electron-accepting compound such as a phenolic compound, movement in electron from the dye precursor to the electron-accepting compound occurs and a color is formed. At this time, the electron-accepting compound is considered to present at extremely close to the colored dye molecule. Also, when the electron-accepting compound is separated from the colored dye molecule, the colored dye molecule accepts an electron again to become the state of the dye precursor before coloring. The present invention is considered to change the distance between the electron-accepting compound molecule and the dye molecule by heating and to carry out color formation and decolorization.

When the above is described in more detail, a large number of the conventionally known electron-accepting compound which is called to as a reversible color developing agent has an aliphatic chain in the structure so that it can be considered that it is less compatibility with the dye precursor molecule and the colored dye molecule so that it is hardly dissolved at the coagulated state. Also, when the dye precursor molecule and the reversible color developing agent molecule are in a freely movable state as in the melted state, the dye precursor molecule and the reversible color developing agent molecule are each dissolved with a certain ratio and become a colored state. Therefore, when the mixture at the color-forming and melting state is gradually cooled, as the temperature lowers, the reversible color developing agent molecule and the dye precursor molecule become the state of not dissolving with each other to cause phase separation and discolored.

The reversible color developing agent represented by the formula (I) to be used in the present invention contains, in particular, a bond having an ability of causing a hydrogen bond such as an amide bonding in the molecule, so that it rapidly crystallizes by the intramolecular hydrogen bond. At the crystallized state, these molecules are stabilized by the hydrogen bonding group such as the amide bonding group, etc., and the phenolic hydroxyl group which is a color forming site also forms a stable intramolecular hydrogen bond so that a more stable crystal, i.e., a decolorized state is formed. On the other hand, when the mixture in a fused state is rapidly cooled, crystallization after phase separation cannot accompany by the temperature change and it solidifies at the colored state so that the colored state is fixed and the colored state is stably maintained after solidification, i.e., after cooling. In the reversible color developing agent of the present invention, the distance between the phenolic hydroxyl group which is a color forming site and the specific hydrogen bonding group existing the amide bonding group is separated with a certain extent so that the degree of freedom at the color forming site is increased whereby the color forming ability becomes high. The reason why the color can be decolorized within a short period of time in spite of the high color forming ability can be considered that the specific hydrogen bonding group such as the amide bonding group forms a hydrogen bond with a certain extent even when it is in a colored state.

The decolorization promoting agents represented by the formulae (II) to (IX) to be used in the present invention have an aliphatic chain in the molecule as in the reversible color developing agent represented by the formula (I) so that they have compatibility with the reversible color developing agent. The decolorization promoting agents generally have a low melting point than the reversible color developing agent whereby the decolorization phenomenon is more accelerated.

In the following, specific synthetic examples of the reversible color developing agent represented by the formula (I) are shown.

SYNTHETIC EXAMPLE 1

Synthesis of ethyl 11-(p-benzyloxyphenoxy) undecanoate

In a 5000 ml flask equipped with a stirrer and a condenser were charged 400.2 g of hydroquinone monobenzyl ether, 586.5 g of ethyl 11-bromoundecanoate, 331.7 g of anhydrous potassium carbonate, 33.2 g of potassium iodide and 1500 ml of N,N-dimethylformamide (DMF), and the mixture was refluxed for 6 hours. This solution was poured into 2000 ml of ice-water to precipitate white crystals. The precipitated crystals were collected by filtration, washed with distilled water and recrystallized from ethanol to obtain 535.5 g of the title compound.

SYNTHETIC EXAMPLE 2

Synthesis of ethyl 11-(p-hydroxyphenoxy) undecanoate

In a 1000 ml pressure resistant flask equipped with a stirrer were charged 100.0 g of ethyl 11-(p-benzyloxyphenoxy)undecanoate synthesized in Synthetic example 1, 3.0 g of a 10% palladium-carbon, 400 ml of 1,4-dioxane and 200 ml of ethanol, and the mixture was heated to 60° C. and under pressurized conditions of an inner vessel pressure at 2.5 kgf/cm$^2$, a hydrogen gas was passed through and the mixture was vigorously stirred for 3 hours. Insolubles were removed by filtration, and the filtrate was concentrated to precipitate crystals. The resulting crystals were washed with cooled n-hexane to obtain 73.4 g of the title compound.

SYNTHETIC EXAMPLE 3

Synthesis of 11-(p-hydroxyphenoxy)undecanoic acid hydrazide

In a 300 ml flask equipped with a stirrer and a condenser were charged 32.2 g of ethyl 11-(p-hydroxyphenoxy)

undecanoate synthesized in Synthetic example 2, 20.0 g of hydrated hydrazine and 200 ml of ethanol, and the mixture was refluxed for 40 hours. After completion of the reaction, the reaction mixture was cooled to room temperature and precipitated crystals were collected by filtration. The resulting crystals were washed with ethanol to obtain 29.0 g of the title compound.

SYNTHETIC EXAMPLE 4

Synthesis of N-[11-(p-hydroxyphenoxy)undecano]-N-decanohydrazide

In a 300 ml flask equipped with a stirrer and a condenser were charged 6.1 g of 11-(p-hydroxyphenoxy)undecanoic acid hydrazide synthesized in Synthetic example 3, 2.2 g of triethylamine and 100 ml of N,N-dimethylacetamide (DMAc), and 3.8 g of n-decanoic acid chloride was added dropwise to the mixture at room temperature under stirring. After completion of dropwise addition, the mixture was heated to 50° C. and stirred for 2 hours. After completion of the reaction, the reaction mixture was poured into 150 ml of a 10% diluted hydrochloric acid and precipitated crystals were collected by filtration. The resulting crystals were washed with distilled water until the washed solution became neutral, and recrystallized from isopropyl alcohol to obtain 7.4 g of the title compound. Melting point: 165° C.

SYNTHETIC EXAMPLE 5

Synthesis of 11-(p-hydroxyphenoxy)undecanoic acid

In a 500 ml flask equipped with a stirrer and a condenser were charged 32.2 g of ethyl 11-(p-hydroxyphenoxy) undecanoate synthesized in Synthetic example 2, 100 g of a 10% aqueous sodium hydroxide solution and 100 ml of ethanol, and the mixture was refluxed for 2 hours. After completion of the reaction, the reaction mixture was concentrated, poured into 600 ml of a 2% aqueous hydrochloric acid solution and precipitated crystals were collected by filtration. The resulting crystals were washed with distilled water and recrystallized from acetonitrile to obtain 20.2 g of the title compound.

SYNTHETIC EXAMPLE 6

Synthesis of ethyl 3-hexylthiopropionate

In a 300 ml flask equipped with a stirrer and a condenser were charged 14.1 g of ethyl 3-mercaptopropionate, 16.5 g of 1-bromohexane, 16.6 g of anhydrous potassium carbonate, 1.7 g of potassium iodide and 80 ml of DMAc, and the mixture was stirred at 80° C. for 3 hours. After completion of the reaction, the reaction mixture was poured into 300 ml of ice-water and the mixture was extracted twice with ethyl acetate. These ethyl acetate extracts were combined, washed with distilled water and then with an aqueous saturated saline solution and dehydrated over anhydrous sodium sulfate. When ethyl acetate was removed by distillation to obtain 20.0 g of the title compound.

SYNTHETIC EXAMPLE 7

Synthesis of 3-hexylthiopropionic acid hydrazide

In a 300 ml flask equipped with a stirrer and a condenser were charged 20.0 g of ethyl 3-hexylthiopropionate synthesized in Synthetic example 6, 22.9 g of hydrated hydrazine and 150 ml of ethanol, and the mixture was refluxed for 12 hours. After completion of the reaction, the reaction mixture was poured into 400 ml of ice-water and precipitated crystals were collected by filtration. The resulting crystals were washed with distilled water, dissolved in ethyl acetate and the solution was further washed with a saturated saline solution. The resulting solution was dried over anhydrous sodium sulfate, ethyl acetate was removed by distillation and the residue was recrystallized from n-hexane to obtain 17.4 g of the title compound.

SYNTHETIC EXAMPLE 8

Synthesis of N-[11-(p-hydroxyphenoxy)undecano]-N'-(3-hexylthio)propionohydrazide In a 300 ml flask equipped with a stirrer and a condenser were charged 5.9 g of the carboxylic acid synthesized in Synthetic example 5, 4.3 g of the hydrazide synthesized in Synthetic example 7, 2.8 g of N,N'-diisopropylcarbodiimide (DIC), 3.4 g of 1-hydroxybenzotriazole (HOBt) and 100 ml of tetrahydrofuran (THF), and the mixture was refluxed for 2 hours. After completion of the reaction, the reaction mixture was cooled to room temperature and precipitated crystals were collected by filtration. The resulting crystals were washed with THF and recrystallized from IPA to obtain 7.8 g of the title compound. Melting point: 160° C.

SYNTHETIC EXAMPLE 9

Synthesis of ethyl 4-hexylthiobutyrate

In a 300 ml flask equipped with a stirrer and a condenser were charged 15.6 g of ethyl 4-bromobutyrate, 9.4 g of n-hexylmercaptane, 13.3 g of anhydrous potassium carbonate, 1.4 g of potassium iodide and 80 ml of DMAc, and the mixture was stirred at 80° C. for 3 hours. After completion of the reaction, the reaction mixture was poured into 300 ml of ice-water and extracted twice with ethyl acetate. These ethyl acetate extracts were combined, washed with distilled water and then with an aqueous saturated saline solution in this order and dehydrated over anhydrous sodium sulfate. When ethyl acetate was removed by distillation to obtain 17.1 g of the title compound.

SYNTHETIC EXAMPLE 10

Synthesis of 4-hexylthiobutyric acid hydrazide

In a 300 ml flask equipped with a stirrer and a condenser were charged 17.1 g of ethyl 4-hexylthiobutrate synthesized in Synthetic Example 9, 20.0 g of hydrated hydrazine and 120 ml of ethanol, and the mixture was refluxed for 12 hours. After completion of the reaction, the reaction mixture was poured into 400 ml of ice-water and precipitated crystals were collected by filtration. The resulting crystals were washed with distilled water, dissolved in ethyl acetate and the solution was further washed with a saturated saline solution. The resulting solution was dried over anhydrous sodium sulfate, ethyl acetate was removed by distillation and the residue was recrystallized from n-hexane to obtain 13.8 g of the title compound.

SYNTHETIC EXAMPLE 11

Synthesis of N-[l1-(p-hydroxyphenoxy)undecano]-N'-(4-hexylthio)propionohydrazide In a 300 ml flask equipped with a stirrer and a condenser were charged 5.9 g of the carboxylic acid synthesized in Synthetic example 5, 4.5 g of the hydrazide synthesized in Synthetic example 10, 2.8 g of DIC, 3.4 g of HOBt and 100 ml of THF, and the mixture was refluxed for 2 hours. After completion of the reaction, the reaction mixture was cooled to room temperature and precipitated crystals were collected by filtration. The resulting crystals were washed with THF and recrystallized from IPA to obtain 8.0 g of the title compound. Melting point: 158° C.

In the following, specific synthetic examples of the decolorization promoter represented by the formulae (II) to (IX) are shown.

SYNTHETIC EXAMPLE 12

Synthesis of 11-decylthioundecanoic acid

In a 3000 ml flask equipped with a stirrer and a condenser were charged 132 g of 11-bromoundecanoic acid, 91.5 g of n-decanthiol, 59.4 g of sodium methoxide (28% methanol solution) and 1500 ml of methanol, and the mixture was refluxed for 12 hours. After completion of the reaction, the reaction mixture was cooled to room temperature, precipitated crystals were collected by filtration under reduced pressure and the resulting crystals were washed with methanol. The resulting crystals were suspended in 5000 ml of distilled water, and the suspension was neutralized by a conc. hydrochloric acid, and the crystals were again collected by filtration under reduced pressure. The crystals were washed with water until the washed solution became neutral, and recrystallized from ethanol to obtain 140.5 g of the title compound.

SYNTHETIC EXAMPLE 13

Synthesis of N-(3-diethylaminopropyl)-11-decylthioundecanamide

In a 300 ml flask equipped with a stirrer and a condenser were charged 14.3 g of the carboxylic acid synthesized in Synthetic example 12, 5.7 g of thionyl chloride, one drop of DMF and 40 ml of chloroform, and the mixture was refluxed for 2 hours. After completion of the reaction, chloroform and excessive thionyl chloride were removed by distillation under reduced pressure, a colorless transparent oily product was obtained. The product was dissolved by adding 10 ml of toluene, and the toluene was removed again under reduced pressure. 7.5 g of acid chloride was added dropwise to 2.6 g of N,N-diethylamino-1,3-diaminopropane dissolved in 50 ml of DMAc solution which had been previously charged in a 200 ml flask, and the mixture was stirred at room temperature for 2 hours. After completion of the reaction, the reaction mixture was diluted with 300 ml of toluene, and washed successively with a 5% aqueous sodium hydrogen carbonate solution, distilled water and a saturated saline solution. The organic layer was dried over anhydrous magnesium sulfate and the solvent was removed under reduced pressure to obtain crystals. The resulting crystals were recrystallized from n-hexane to obtain 6.9 g of the title compound.

Melting point: 61° C.

SYNTHETIC EXAMPLE 14

Synthesis of N-(2-morpholinoethyl)-11-decylthioundecanamide

In a 200 ml flask equipped with a stirrer, a condenser and a calcium chloride dryer tube were charged 2.6 g of morpholine and 50 ml of DMAc and the mixture was stirred under ice-cooling. To the solution was gradually added dropwise 7.5 g of 11-decylthioundecanoic acid chloride prepared in Synthetic example 13. After completion of dropwise addition, the mixture was returned to room temperature and further stirred for 2 hours. The reaction solution was diluted with 300 ml of toluene, and washed successively with a 5% aqueous sodium hydrogen carbonate solution, distilled water and a saturated saline solution. The organic layer was dried over anhydrous magnesium sulfate and the solvent was removed under reduced pressure to obtain crystals. The crystals were recrystallized from n-hexane to obtain 6.9 g of the title compound. Melting point: 61° C.

SYNTHETIC EXAMPLE 15

Synthesis of N-10-decylthiodecylcarbamidic acid-2-morpholinoethyl

In a 100 ml conical flask equipped with a stirrer and a condenser were charged 7.5 g of 11-decylthioundecanoic acid chloride and 20 ml of acetone and the mixture was stirred under ice-cooling. To the solution was gradually added dropwise 2.0 g of sodium azide dissolved in 5 ml of water.

After completion of dropwise addition, the mixture was stirred at the same temperature for further one hour. The reaction solution was diluted with 300 ml of toluene, and washed successively with distilled water and a saturated saline solution. The organic layer was dried over anhydrous sodium sulfate and the filtrate was refluxed for one hour. To the reaction mixture was added 2.6 g of N-β-hydroxyethylmorpholine and the mixture was further refluxed for 3 hours. After completion of the reaction, the solvent was removed under reduced pressure, and the residue was recrystallized from n-hexane to obtain 5.9 g of the title compound. Melting point: 91° C.

SYNTHETIC EXAMPLE 16

Synthesis of N-(3-morpholinopropyl)-3-dodecylthiopropanamide

In a 200 ml flask equipped with a stirrer, a condenser and a calcium chloride dryer tube were charged 8.23 g of 3-dodecylthiopropionic acid, 4.6 g of oxalyl chloride and 50 ml of toluene, and the mixture was stirred under room temperature for 20 hours. After completion of the reaction, excessive oxalyl chloride and toluene were removed by distillation under reduced pressure to prepare acid chloride. Whole amount of the resulting acid chloride was gradually added dropwise to 5.2 g of N-(3-aminopropyl)morpholine, 3.7 g of triethylamine and 60 ml of DMAc solution which had been previously charged in a flask, and after completion of the dropwise addition, the mixture was stirred at room temperature for 2 hours. After completion of the reaction, the reaction mixture was poured into 300 ml of distilled water and extracted with chloroform. The chloroform layer was washed with a saturated saline solution and chloroform was removed by distillation. The residue was recrystallized from methanol to obtain 6.5 g of the title compound. Melting point: 46° C.

SYNTHETIC EXAMPLE 17

Synthesis of N-[3-(diethoxyphosphoryl)propiono]-N'-octadecanohydrazide

In a 300 ml flask equipped with a stirrer and a condenser were charged 10.0 g of N-[3-(diethoxyphosphoryl) propiono]-hydrazide, 5.4 g of triethylamine and 100 ml of DMAc, and the mixture was stirred while cooling with a water bath. To the solution was gradually added dropwise 13.5 g of octadecanoic acid chloride and stirring was continued for one hour. Next, the mixture was heated to 50° C. by hot water bath under stirring. The reaction mixture was cooled to room temperature, and the precipitated crystals were collected by filtration under reduced pressure and washed with distilled water. The residue was recrystallized from 2-methoxyethanol to obtain 8.5 g of the title compound. Melting point: 85° C.

SYNTHETIC EXAMPLE 18

Synthesis of N-[3-(methylsulfinyl)propyl]-N'-octadecylurea

In a 300 ml flask equipped with a stirrer, a condenser and a calcium chloride dryer tube were charged 10.6 g of 3-(methylsulfinyl)propylamine hydrobromide, 5.6 g of triethylamine and 100 ml of acetone, and the mixture was stirred at room temperature. To the solution was gradually added dropwise 14.8 g of octadecyl isocyanurate. After completion of the dropwise addition, the mixture was returned to room temperature and further refluxed for 2 hours. After cooling the reaction mixture to room temperature, the precipitated crystals were collected by filtration under reduced pressure and washed with distilled water. The residue was recrystallized from IPA to obtain 14.9 g of the title compound. Melting point: 105° C.

SYNTHETIC EXAMPLE 19

Synthesis of N-[3-(methylsulfinyl)propionyl]-N'-octadecanohydrazide

In a 300 ml flask equipped with a stirrer, a condenser and a calcium chloride dryer tube were charged 7.5 g of 3-(methylsulfinyl)propionylhydrazide, 6.1 g of triethylamine and 100 ml of DMAc, and the mixture was stirred under ice-cooling. To the solution was gradually added dropwise 15.1 g of octadecanoic acid chloride. After completion of the dropwise addition, the mixture was returned to room temperature and further stirred at 60° C. by hot water bath for 2 hours. After cooling the reaction mixture to room temperature, the precipitated crystals were collected by filtration under reduced pressure and washed with distilled water. The residue was recrystallized from IPA to obtain 13.6 g of the title compound. Melting point: 144° C.

SYNTHETIC EXAMPLE 20

Synthesis of N-octadecylsuccinimide

In a 500 ml flask equipped with a stirrer and a condenser were charged 30.6 g of 1-bromoctadecane, 10.0 g of succinimide, 13.9 g of potassium carbonate, 0.5 g of potassium iodide and 60 ml of DMF, and the mixture was stirred on an oil bath at 100° C. After cooling the reaction mixture to room temperature, it was poured into a large amount of distilled water, and the precipitated crystals were collected by filtration under reduced pressure and washed with distilled water. The residue was recrystallized from IPA to obtain 28.5 g of the title compound. Melting point: 76° C.

SYNTHETIC EXAMPLE 21

Synthesis of 11-dodecylthioundecanoic acid

In a 1000 ml flask equipped with a stirrer, a condenser and a calcium chloride dryer tube were charged 26.6 g of 11-bromoundecanoic acid, 21.2 g of 1-dodecanthiol, 42.4 ml of sodium methoxide (28% methanol solution) and 300 ml of methanol, and the mixture was refluxed for 6 hours on an oil bath. After cooling the reaction mixture to room temperature, the precipitated crystals were collected by filtration under reduced pressure and washed with methanol. The resulting crystals were suspended in 1000 ml of distilled water, and the suspension was made pH 2 by adding a conc. hydrochloric acid, and suspension was stirred on an oil bath at 60° C. for 30 minutes to carry out neutraliza tion. Crystals after neutralization were collected by filtration under reduced pressure and washed with distilled water. The residue was recrystallized from ethanol to obtain 35.2 g of the title compound.

SYNTHETIC EXAMPLE 22

Synthesis of 10-dodecylthiodecylamine hydrobromide

In a 1000 ml flask equipped with a stirrer, a condenser and a calcium chloride dryer tube were charged 27.0 g of the carboxylic acid synthesized in Synthetic example 21, 10.0 g of thionyl chloride, one drop of DMF and 100 ml of chloroform, and the mixture was refluxed for 2 hours on an oil bath. After completion of the reaction, chloroform and excessive thionyl chloride were removed by distillation under reduced pressure to obtain acid chloride. Whole content of the resulting acid chloride was diluted with 100 ml of acetone, and added dropwise under ice-cooling to 5.9 g of sodium azide dissolved in 60 ml of distilled water which had been previously charged in a 300 ml flask. After completion of the dropwise addition, the mixture was stirred at the same temperature for one hour and the mixture was extracted twice with 300 ml of toluene. The organic layers were combined and washed three times with distilled water and once with a saturated saline solution. The organic layer was dried over anhydrous sodium sulfate and the filtrate was refluxed for one hour. To the mixture were added 11.3 g of benzyl alcohol and 3 drops of triethylamine, and the resulting mixture was further refluxed for 2 hours. After completion of the reaction, toluene was removed under reduced pressure and the residual crystals were recrystallized from ethanol to obtain 26.5 g of benzyl N-(10-dodecylthio) decylcarbamate. In a 300 ml flask were charged 24.5 g of the resulting benzyl N-(10-dodecylthio)decylcarbamate, 20 ml of 48% hydrobromic acid and 180 ml of glacial acetic acid and the mixture was refluxed for 2 hours. After completion of the reaction, glacial acetic acid was removed under reduced pressure and the residual crystals were recrystallized from ethanol to obtain 17.0 g of the title compound.

SYNTHETIC EXAMPLE 23

Synthesis of N-(10-dodecylthio)decylsuccinimide

In a 200 ml flask equipped with a stirrer, a condenser and a calcium chloride dryer tube were charged 4.4 g of the HBr salt of amine synthesized in Synthetic example 22, 1.1 g of succinic acid anhydride, 1.0 g of triethylamine and 50 ml of 1,4-dioxane, and the mixture was stirred at 50° C. for 1.5 hours on a hot water bath. To the mixture was added 1.5 g of acetic anhydride and 0.4 g of sodium acetate and the mixture was further refluxed for 3 hours. After completion of the reaction, 1,4-dioxane was removed under reduced pressure and when the residue was poured into 50 ml of a 1% diluted hydrochloric acid, crystals were precipitated. The crystals were collected by filtration and washed with distilled water until the washed solution became neutral, and recrystallized from a mixed solvent of methanol and IPA to obtain 3.0 g of the title compound. Melting point: 86° C.

SYNTHETIC EXAMPLE 24

Synthesis of docosanohydrazide

In a 500 ml flask equipped with a stirrer, a condenser and a calcium chloride dryer tube were charged 17.0 g of docosanoic acid, 1.0 g of p-toluenesulfonic acid monohydrate and 200 ml of n-propanol, and the mixture was refluxed for 4 hours. Thereafter, to the solution was added 12.5 g of hydrated hydrazine, and the mixture was further refluxed for 20 hours. After cooling the reaction mixture to room temperature, the precipitated crystals were collected by filtration under reduced pressure and washed with distilled water. The resulting crystals were recrystallized from IPA to obtain 14.2 g of the title compound. Melting point: 117° C.

SYNTHETIC EXAMPLE 25

Synthesis of N-octadecyloxamide

In a 500 ml flask equipped with a stirrer, a condenser and a calcium chloride dryer tube were charged 13.5 g of octadecylamine, 6.4 g of ethyl oxamidate and 200 ml of ethanol, and the mixture was refluxed for one hour. After cooling the reaction mixture to room temperature, the precipitated crystals were collected by filtration under reduced pressure. The resulting crystals were recrystallized from ethanol to obtain 12.8 g of the title compound. Melting point: 169° C.

SYNTHETIC EXAMPLE 26

Synthesis of 4-octadecylsemicarbazide

In a 500 ml flask equipped with a stirrer, a condenser and a calcium chloride dryer tube were charged 20.0 g of hydrated hydrazine and 200 ml of ethanol, and the mixture was stirred under ice-cooling. To the solution was gradually added dropwise 14.8 g of octadecyl isocyanurate. After completion of the dropwise addition, the reaction mixture was returned to room temperature and stirred for one hour, and the precipitated crystals were collected by filtration under reduced pressure. The resulting crystals were recrystallized from ethanol to obtain 8.2 g of the title compound. Melting point: 100° C.

SYNTHETIC EXAMPLE 27

Synthesis of 6-(octadecylthio)hexanamide

In a 300 ml flask equipped with a stirrer, a condenser and a calcium chloride dryer tube were charged 19.3 g of ammonium acetate and 100 ml of DMAc, and the mixture was stirred at room temperature. Then, to the solution was gradually added dropwise 21.0 g of 6-(octadecylthio) hexanoic acid chloride and stirring of the mixture was continued for further 20 hours. The mixture was stirred at 60° C. for further 2 hours on a hot water bath. After cooling the reaction mixture to room temperature, the precipitated crystals were collected by filtration under reduced pressure and washed with acetone. The resulting crystals were collected by filtration under reduced pressure and washed with distilled water and recrystallized from IPA to obtain 16.0 g of the title compound as white crystals. Melting point: 105° C.

SYNTHETIC EXAMPLE 28

Synthesis of 11-(octadecylthio)undecanamide

In a 300 ml flask equipped with a stirrer, a condenser and a calcium chloride dryer tube were charged 13.2 g of octadecanthiol, 14.3 g of 11-bromoundedanamide, 1.7 g of potassium iodide, 20.7 g of potassium carbonate and 100 ml of DMAc, and the mixture was stirred at 100° C. for 5 hours. After cooling the reaction mixture to room temperature, the reaction mixture was poured into ice-water and precipitated crystals were collected by filtration under reduced pressure, and washed with distilled water. The resulting crystals were recrystallized from IPA to obtain 16.4 g of the title compound. Melting point: 108° C.

SYNTHETIC EXAMPLE 29

Synthesis of 11-(hexadecylthio)undecanohydrazide

In a 500 ml flask equipped with a stirrer, a condenser and a calcium chloride dryer tube were charged 22.1 g of 11-(hexadecylthio)undecanoic acid, 1.0 g of p-toluenesulfonic acid monohydrate and 100 ml of n-propanol, and the mixture was refluxed for 4 hours. Thereafter, to the solution was added 12.5 g of hydrated hydrazine and reflux was further continued for 20 hours. After cooling the reaction mixture to room temperature, precipitated crystals were collected by filtration under reduced pressure, and washed with distilled water. The resulting crystals were recrystallized from IPA to obtain 16.0 g of the title compound. Melting point: 108° C.

SYNTHETIC EXAMPLE 30

Synthesis of 3-(docosylthio)propionohydrazide

In a 300 ml flask equipped with a stirrer, a condenser and a calcium chloride dryer tube were charged 22.1 g of ethyl 3-(docosylthio)propionate, 150 ml of n-propanol and 12.5 g of hydrated hydrazine, and the mixture was refluxed for 20 hours. After cooling the reaction mixture to room temperature, precipitated crystals were collected by filtration under reduced pressure, and washed with distilled water. The resulting crystals were recrystallized from IPA to obtain 17.2 g of the title compound. Melting point: 106° C.

SYNTHETIC EXAMPLE 31

Synthesis of 1-methyl-3-octadecylimidazolium p-toluenesulfonate

In a 100 ml flask equipped with a stirrer, a condenser and a calcium chloride dryer tube were charged 3.7 g of 1-methylimidazole and 10.0 g of octadecyl p-toluenesulfonate, and the mixture was stirred at 120° C. for 5 hours. After cooling the reaction mixture to room temperature, precipitated crystals were collected by filtration under reduced pressure. The resulting crystals were recrystallized from acetone to obtain 10.9 g of the title compound. Melting point: 71° C.

SYNTHETIC EXAMPLE 32

Synthesis of N-octadecylthiazolium bromide

In a 100 ml flask equipped with a stirrer, a condenser and a calcium chloride dryer tube were charged 3.8 g of thiazole and 10.0 g of 1-bromoctadecane, and the mixture was stirred at 120° C. for 5 hours. After cooling the reaction mixture to room temperature, precipitated crystals were collected by filtration under reduced pressure. The resulting crystals were recrystallized from a mixed solvent of acetone and methanol to obtain 9.1 g of the title compound. Melting point: 83° C.

SYNTHETIC EXAMPLE 33

Synthesis of N-octadecylthiazolium perchlorate

In a 100 ml flask equipped with a stirrer, a condenser and a calcium chloride dryer tube were charged 4.2 g of N-octadecylthiazolium bromide synthesized in Synthetic example 32 and 10.0 g of methanol, and then, 2.1 g of sodium perchlorate was added to the mixture. After the addition, the mixture was refluxed for 30 minutes. After cooling the reaction mixture to room temperature, precipitated crystals were collected by filtration under reduced pressure. The resulting crystals were washed with acetone to obtain 3.1 g of the title compound. Melting point: 91° C.

SYNTHETIC EXAMPLE 34

Synthesis of N-octadecylpyridinium p-toluenesulfonate

In a 100 ml flask equipped with a stirrer, a condenser and a calcium chloride dryer tube were charged 9.3 g of pyridine and 5.0 g of octadecyl p-toluenesulfonate, and the mixture was refluxed for 6 hours. After cooling the reaction mixture to room temperature, precipitated crystals were collected by filtration under reduced pressure. The resulting crystals were washed with acetone to obtain 5.9 g of the title compound. Melting point: 133*.

SYNTHETIC EXAMPLE 35

Synthesis of 1,12-pyridiniumdodecane dibromide

In a 100 ml flask equipped with a stirrer, a condenser and a calcium chloride dryer tube were charged 9.8 g of 1,12-dibromododecane and 24.0 g of pyridine, and the mixture was refluxed for 7 hours. After cooling the reaction mixture to room temperature, precipitated crystals were collected by filtration under reduced pressure. The resulting crystals were washed with acetone to obtain 14.9 g of the title compound. Melting point: 111° C.

SYNTHETIC EXAMPLE 36

Synthesis of 1,12-pyridiniumdodecane dihexafluorophosphate

In a 100 ml flask equipped with a stirrer, a condenser and a calcium chloride dryer tube were charged 4.9 g of 1,12-pyridiniumdodecane dibromide synthesized in Synthetic example 35 and 60.0 g of distilled water, and then, 10 ml of 60% aqueous hexafluorophosphoric acid solution was added dropwise to the mixture. After completion of the dropwise addition, the mixture was stirred at room temperature for 15 minutes. Precipitated crystals were collected by filtration under reduced pressure, and after sufficiently washing the resulting crystals with distilled water, the resulting crystals were recrystallized from methanol to obtain 5.5 g of the title compound. Melting point: 120° C.

SYNTHETIC EXAMPLE 37

Synthesis of hexadecyltriphenylphosphonium bromide

In a 100 ml flask equipped with a stirrer, a condenser and a calcium chloride dryer tube were charged 8.6 g of triphenylphosphine and 10 g of n-hexadecyl bromide, and under nitrogen atmosphere, the mixture was heated at 180° C. for 10 hours on an oil bath. After cooling the reaction mixture to room temperature, precipitated solid material was pulverized in acetone and collected by filtration under reduced pressure. The resulting crystals were washed with acetone to obtain 8.5 g of the title compound. Melting point: 128° C.

SYNTHETIC EXAMPLE 38

Synthesis of tetramethylammonium tetraphenylborate

In a 500 ml flask equipped with a stirrer and a calcium chloride dryer tube was charged 91.2 g of tetramethylammonium hydroxide (10% methanol solution) and under ice-cooling while stirring, 12 g of conc. hydrochloric acid was added to the mixture and stirring was further continued for 15 minutes. Methanol was removed under reduced pressure, 200 ml of ethanol was added to the residue. The mixture was stirred at room temperature for 5 minutes and insolubles were removed by filtration. The filtrate was concentrated under reduced pressure to obtain 11.5 g of tetramethylammonium chloride as a colorless solid.

To 7.23 g of sodium tetraphenyl borate and 280 ml of acetonitrile which had been previously charged in a 500 ml flask was added 11.5 g of the above-mentioned crude chloride dissolved in 70 ml of acetonitrile and mixed. Precipitated crystals were collected by filtration under reduced pressure and washed with distilled water to obtain 8.9 g of the title compound. Melting point: 290° C. or higher.

SYNTHETIC EXAMPLE 39

Synthesis of hexadecyltriphenylphosphonium tetraphenyl borate

In a 200 ml flask equipped with a stirrer and a calcium chloride dryer tube were charged 2.0 g of hexadecyltriphenylphosphonium bromide synthesized in Synthetic example 37 and 40 ml of ethanol, and then, 1.6 g of tetramethylammonium tetraphenylborate synthesized in Synthetic example 38 was added to the mixture. After refluxing the mixture for 14 minutes, 80 ml of distilled water was added to the reaction mixture, and precipitated crystals were collected by filtration under reduced pressure. The resulting crystals were washed sufficiently with distilled water to obtain 1.6 g of the title compound. Melting point: 300° C. or higher.

SYNTHETIC EXAMPLE 40

Synthesis of dimethyloctadecylsulfonium iodide

In a 200 ml flask equipped with a stirrer and a calcium chloride dryer tube were charged 5.7 g of 1-octadecanthiol, 1.2 g of sodium methoxide and 30 ml of methanol, and the mixture was refluxed for 10 minutes. Then, 3.0 g of methyl iodide was added dropwise to the mixture and reflux was further contented for 30 minutes. The resulting mixture was poured into 200 ml of distilled water, and the resulting precipitate was collected by filtration under reduced pressure to obtain 6.0 g of methyloctadecylsulfide.

In a flask equipped with a stirrer was charged 3.0 g of the crude methyloctadecylsulfide, 2.1 g of methyl iodide and 50 ml of acetone, and the mixture was stirred at room temperature for 24 hours. Precipitated crystals were collected by filtration under reduced pressure and recrystallized from acetone to obtain 3.4 g of the title compound. Melting point: 82.5° C.

EXAMPLES

In the following, the present invention is explained in more detail by referring to Examples. In Examples, all the parts mean "parts by weight" and percentage is based on weight.

Example 1

(A) Preparation of coating solution for forming reversible heat-sensitive recording layer 40 parts of a dye precursor and 100 parts of a reversible color developing agent were pulverized with 9100 parts of a THF solution of 8% polyvinylacetal (available from Sekisui Kagaku Kogyo K.K., BL-1, trade name, 63 mole % of acetal degree) by a paint conditioner to obtain a reversible heat-sensitive coating solution (Solution A).

(B) Preparation of decolorization promoter coating solution 5 parts of a decolorization promoter were pulverized with 20 parts of THF by using a paint conditioner to prepare a decolorization promoter coating solution (Solution B).

(C) Mixing of decolorization promoter coating solution and coating solution for forming reversible heat-sensitive recording layer The above two kinds of dispersions, Solution A and Solution B were mixed to prepare a coating solution for forming a The above two kinds of dispersions, Solution A and Solution B were mixed to prepare a coating solution for forming a reversible heat-sensitive recording layer to which a decolorization promoting agent is added.

(D) Coating of coating solution for forming reversible heat-sensitive recording layer To the coating solution for forming a reversible heat-sensitive recording layer prepared in (A) or (C) was added 29 parts of Colonate L (trade name, available from Nippon Polyurethane), and then the solution was coated on a polyethylene terephthalate (PET) sheet at a coating weight (solid matter) of 4.0 g/m$^2$. The coated material was dried at 60° C. for 24 hours, and subjected to supercalendering to obtain a reversible heat-sensitive recording material.

(E) Coating of protective layer

On the coated layer of the coated sheet obtained in (D) was overcoated a ultraviolet ray-curable resin in which 90 parts of Aronix M8030 (trade name, available from Toa Gosei Kagaku Kogyo Co.), 5 parts of N-vinyl-2-pyrrolidone, 5 parts of Irgacure 500 (trade name, available from Nippon Ciba-Geigy Co.) and 10 parts of Nipseal E220A (trade name, available from Nippon Silica Co.) had been mixed at a coating weight (solid matter) of 1.0 g/m$^2$, and then, curing was carried out by a UV-irradiating apparatus (available from Ushio Denki Co., Rapid Cure, trade name) to obtain a reversible heat-sensitive recording material having a protective layer.

In the following, reversible color developing agents, decolorization promoting agents and dye precursors used in Examples are shown as (D-1) to (D-30), (E-1) to (E-16) and (BK-1) to (RD-2), respectively.

(D-1)

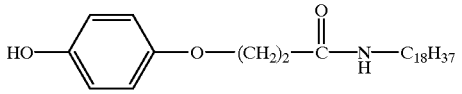

(D-2)

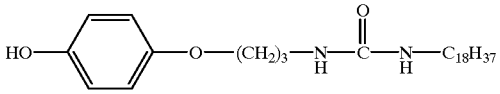

(D-3)

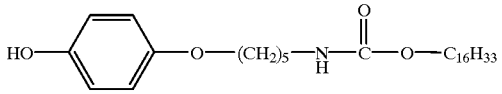

(D-4)

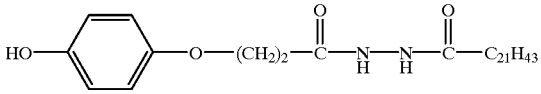

(D-5)

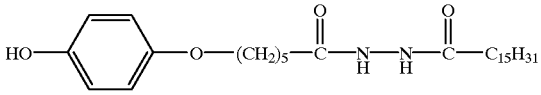

(D-6)

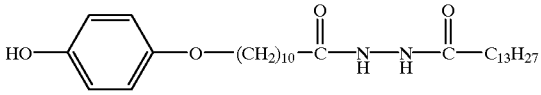

(D-7)

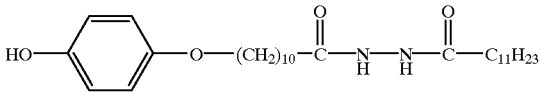

(D-8)

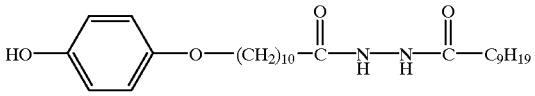

(D-9)

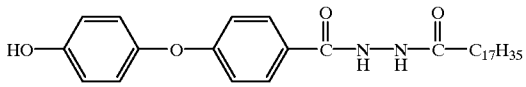

(D-10)

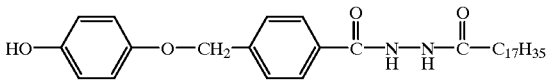

(D-11)

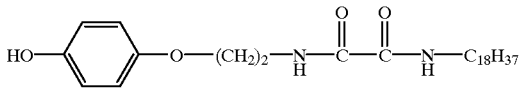

(D-12)

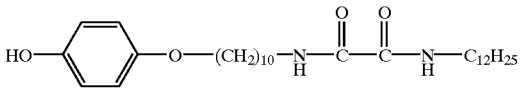

(D-13)

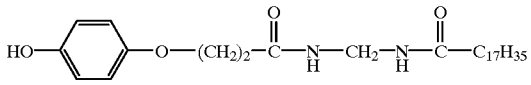

(D-14)

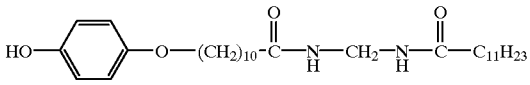

-continued
(D-15)
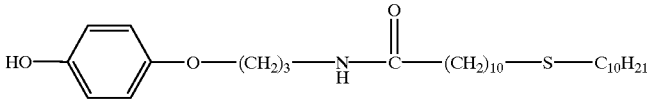
(D-16)
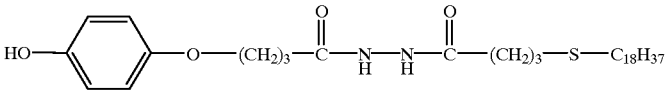
(D-17)
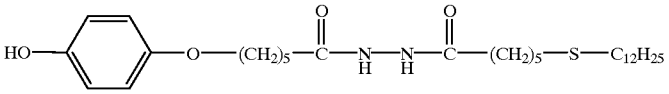
(D-18)
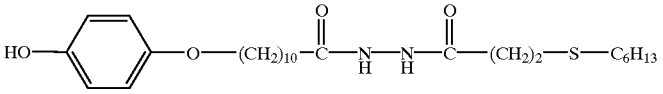
(D-19)
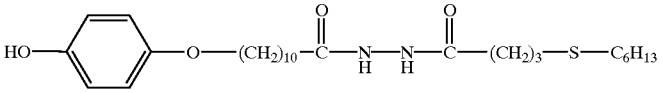
(D-20)
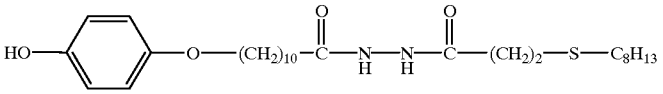
(D-21)
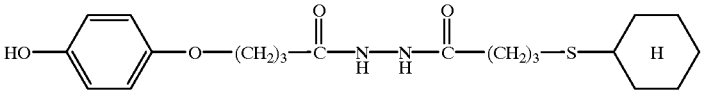
(D-22)
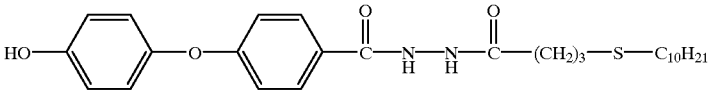
(D-23)
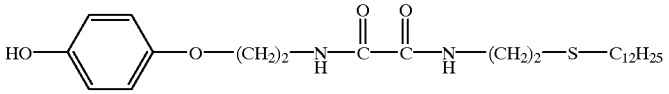
(D-24)
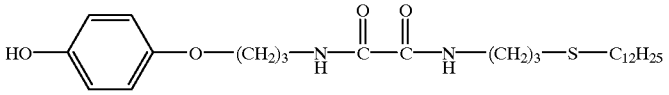
(D-25)
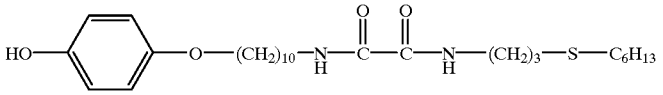
(D-26)
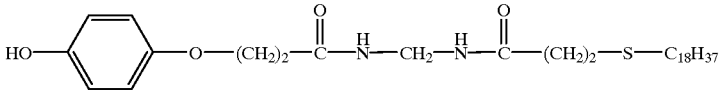
(D-27)
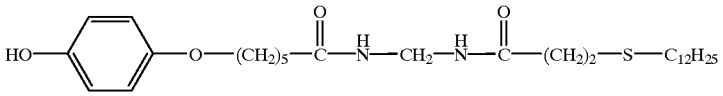

-continued
(D-28)
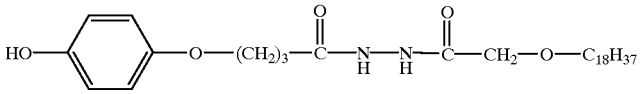
(D-29)
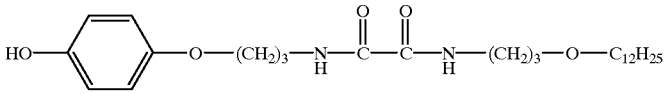
(D-30)
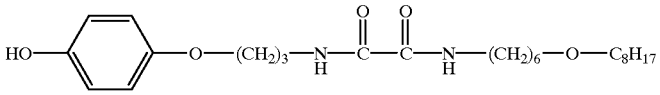
(E-1)
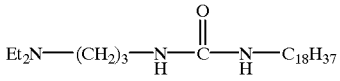
(E-2)
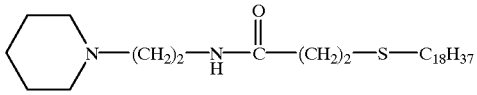
(E-3)
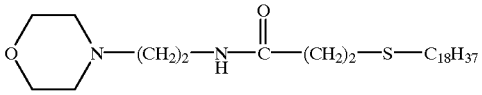
(E-4)
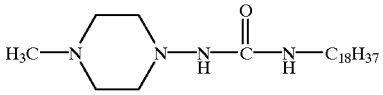
(E-5)
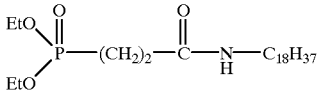
(E-6)
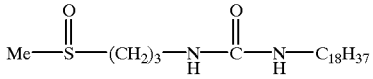
(E-7)
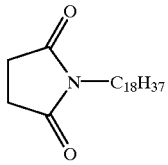
(E-8)
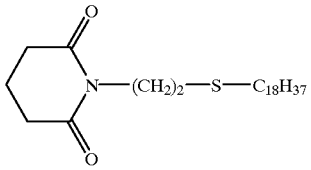
(E-9)
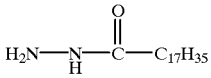
(E-10)
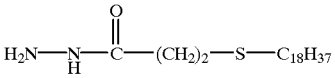
(E11)
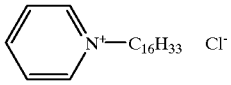
(E-12)
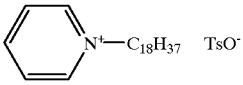
(E13)
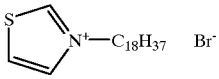
(E-14)
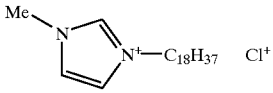
(E15)
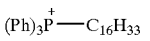
(E-16)
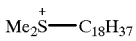
(BK-1)
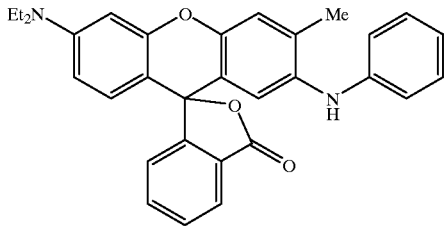
(BK-2)
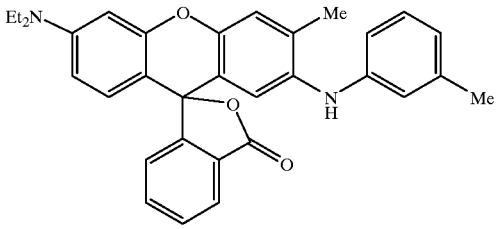

-continued (BL-1)

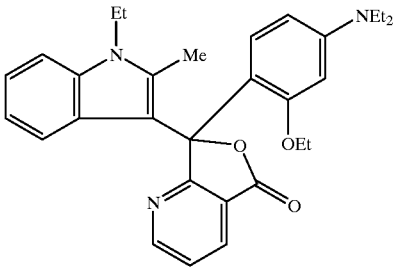

(BL-2)

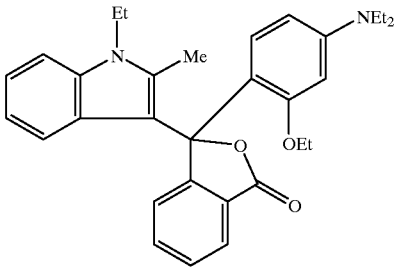

(RD-1)

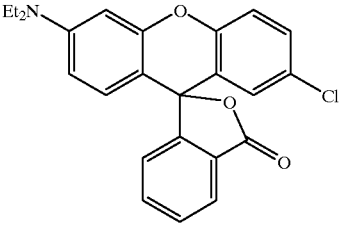

(RD-2)

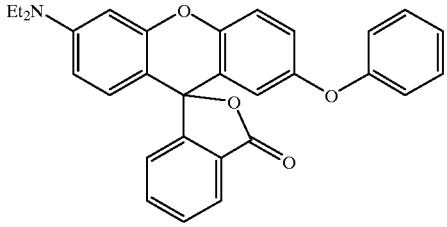

In the following, combinations of reversible color developing agents, decolorization promoters and dye precursors used in Examples are shown in Table 1.

TABLE 1

| | Reversible color developing agent | Decolorization promoter | dye precursor |
|---|---|---|---|
| Example 1 | (D-4) | (BK-1) | — |
| Example 2 | (D-5) | (BK-1) | — |
| Example 3 | (D-6) | (BK-1) | — |
| Example 4 | (D-7) | (BK-1) | — |
| Example 5 | (D-8) | (BK-1) | — |
| Example 6 | (D-9) | (BK-2) | — |
| Example 7 | (D-11) | (BK-2) | — |
| Example 8 | (D-12) | (BK-2) | — |
| Example 9 | (D-13) | (BK-2) | — |
| Example 10 | (D-15) | (BK-2) | — |
| Example 11 | (D-16) | (BK-1) | — |
| Example 12 | (D-17) | (BK-1) | — |
| Example 13 | (D-18) | (BK-1) | — |
| Example 14 | (D-19) | (BK-1) | — |
| Example 15 | (D-20) | (BK-1) | — |
| Example 16 | (D-25) | (BK-2) | — |
| Example 17 | (D-26) | (BK-2) | — |
| Example 18 | (D-28) | (BK-2) | — |
| Example 19 | (D-29) | (BK-2) | — |
| Example 20 | (D-30) | (BK-2) | — |
| Example 21 | (D-2) | (BL-1) | — |
| Example 22 | (D-3) | (BL-2) | — |
| Example 23 | (D-10) | (RD-1) | — |
| Example 24 | (D-14) | (RD-2) | — |
| Example 25 | (D-22) | (BL-1) | — |
| Example 26 | (D-23) | (BL-1) | — |
| Example 27 | (D-24) | (BL-1) | — |
| Example 28 | (D-1) | (BL-2) | — |
| Example 29 | (D-1) | (RD-2) | — |
| Example 30 | (D-21) | (RD-2) | — |
| Example 31 | (D-1) | (BK-1) | (E-1) |
| Example 32 | (D-1) | (BK-2) | (E-2) |
| Example 33 | (D-2) | (BK-1) | (E-3) |
| Example 34 | (D-2) | (BK-2) | (E-4) |
| Example 35 | (D-3) | (BK-1) | (E-5) |
| Example 36 | (D-3) | (BK-2) | (E-6) |
| Example 37 | (D-7) | (BK-1) | (E-7) |
| Example 38 | (D-7) | (BK-2) | (E-8) |
| Example 39 | (D-7) | (BL-1) | (E-9) |
| Example 40 | (D-7) | (BL-2) | (E-10) |

TABLE 1-continued

| | Reversible color developing agent | Decolorization promoter | dye precursor |
|---|---|---|---|
| Example 41 | (D-7) | (RD-1) | (E-15) |
| Example 42 | (D-7) | (RD-2) | (E-16) |
| Example 43 | (D-8) | (BK-1) | (E-3) |
| Example 44 | (D-8) | (BK-2) | (E-4) |
| Example 45 | (D-8) | (BL-1) | (E-11) |
| Example 46 | (D-8) | (BL-2) | (E-12) |
| Example 47 | (D-8) | (RD-1) | (E-13) |
| Example 48 | (D-8) | (RD-2) | (E-14) |
| Example 49 | (D-10) | (BK-1) | (E-1) |
| Example 50 | (D-10) | (BK-2) | (E-4) |
| Example 51 | (D-15) | (BL-1) | (E-7) |
| Example 52 | (D-15) | (RD-2) | (E-8) |
| Example 53 | (D-18) | (BK-1) | (E-11) |
| Example 54 | (D-18) | (BK-2) | (E-12) |
| Example 55 | (D-18) | (BL-1) | (E-13) |
| Example 56 | (D-18) | (BL-2) | (E-14) |
| Example 57 | (D-18) | (RD-1) | (E-15) |
| Example 58 | (D-18) | (RD-2) | (E-16) |
| Example 59 | (D-19) | (BK-1) | (E-13) |
| Example 60 | (D-19) | (BK-2) | (E-14) |
| Example 61 | (D-19) | (BL-1) | (E-15) |
| Example 62 | (D-19) | (BL-2) | (E-16) |
| Example 63 | (D-19) | (RD-1) | (E-11) |
| Example 64 | (D-19) | (RD-2) | (E-12) |
| Example 65 | (D-22) | (BK-1) | (E-1) |
| Example 66 | (D-22) | (BK-2) | (E-1) |
| Example 67 | (D-22) | (BL-1) | (E-7) |
| Example 68 | (D-22) | (BL-2) | (E-7) |
| Example 69 | (D-28) | (BL-1) | (E-13) |
| Example 70 | (D-28) | (BL-2) | (E-14) |

Also, reversible color developing agent used in Comparative examples are shown as (Dst-1) to (Dst-8).

(Dst-1)

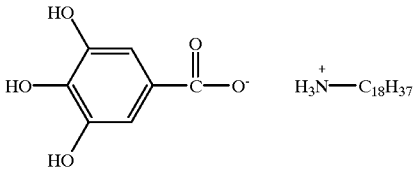

(Dst-2)

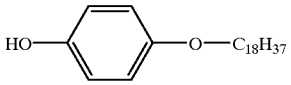

(Dst-3)

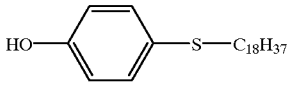

(Dst-4)

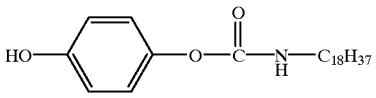

(Dst-5)

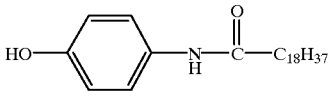

(Dst-6)

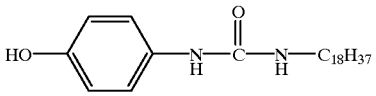

(Dst-7)

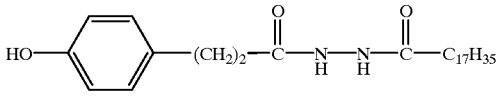

(Dst-8)

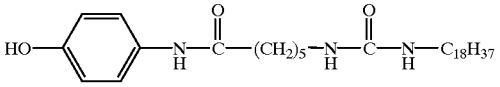

In the following, combinations of reversible color developing agents, decolorization promoters and dye precursors used in Comparative examples are shown in Table 2.

TABLE 2

| | Reversible color developing agent | Decolorization promoter | dye precursor |
|---|---|---|---|
| Comparative example 1 | (Dst-1) | (BK-1) | — |
| Comparative example 2 | (Dst-2) | (BK-1) | — |
| Comparative example 3 | (Dst-3) | (BK-1) | — |
| Comparative example 4 | (Dst-4) | (BK-1) | — |
| Comparative example 5 | (Dst-5) | (BK-1) | — |
| Comparative example 6 | (Dst-6) | (BK-1) | — |
| Comparative example 7 | (Dst-7) | (BK-1) | — |

TABLE 2-continued

| | Reversible color developing agent | Decolorization promoter | dye precursor |
|---|---|---|---|
| Comparative example 8 | (Dst-8) | (BK-1) | — |
| Comparative example 9 | (Dst-8) | (BK-2) | — |
| Comparative example 10 | (Dst-8) | (BL-1) | — |
| Comparative example 11 | (Dst-8) | (BL-2) | — |
| Comparative example 12 | (Dst-8) | (RD-1) | — |
| Comparative example 13 | (Dst-8) | (RD-2) | — |
| Comparative example 14 | (Dst-19) | (BK-1) | Stearyl stearate |
| Comparative example 15 | (Dst-20) | (BL-1) | Dodecyl stearate |
| Comparative example 16 | (Dst-25) | (BK-1) | Dodecanoic acid |
| Comparative example 17 | (Dst-26) | (BL-1) | Cholesterol stearate |
| Comparative example 18 | (Dst-28) | (BK-1) | Stearamide |
| Comparative example 19 | (Dst-29) | (BL-1) | Stearic acid |
| Comparative example 20 | (Dst-30) | (BL-2) | Stearyl stearate |

Test 1 (Color density=thermal responsibility)

By using the reversible heat-sensitive recording materials prepared in Examples 1–70 and Comparative examples 1–20, printing was carried out by using a facsimile printing test machine TH-PMD (trade name, available from Okura Denki, K.K.) attached with a printing head KJT-256-8MGF1 (trade name, available from Kyocera Co.) under the conditions of an applied pulse width of 1.1 msec and an applied voltage of 26 volts, and the resulting colored images were measured by a densitometer Macbeth RD918 (trade name, available from Gretag Macbeth, GB) as a color density.

Test 2 (Decolorization of image)

By using the reversible heat-sensitive recording materials prepared in Examples 1–70 and Comparative examples 1–20, printing was carried out by using a facsimile printing test machine TH-PMD (trade name, available from Okura Denki, K.K.) attached with a printing head KJT-256-8MGF1 (trade name, available from Kyocera Co.) under the conditions of an applied pulse width of 1.1 msec and an applied voltage of 26 volts, and this was heated by using a hot stamp at 150° C. for 1 second, and then, the density was measured in the same manner as in Test 1.

Test 3 (Decolorization starting temperature)

By using the reversible heat-sensitive recording materials prepared in Examples 1–70 and Comparative examples 1–20, printing was carried out by using a facsimile printing test machine TH-PMD (trade name, available from Okura Denki, K.K.) attached with a printing head KJT-256-8MGF1 (trade name, available from Kyocera Co.) under the conditions of an applied pulse width of 1.1 msec and an applied voltage of 26 volts, and this was heated by using a hot stamp at 10 points at a temperature from 80° C. to 170° C. with a distance of 10° C. for each 1 second, and then, the densities were measured in the same manner as in Test 1. A heating temperature at which an optical density of the printed image is below 0.15 is made a decolorization starting temperature.

Test 4 (Change in color density with a lapse of time=image stability)

By using the reversible heat-sensitive recording materials prepared in Examples 1–70 and Comparative examples 1–20, printing was carried out by using a facsimile printing test machine TH-PMD (trade name, available from Okura Denki, K.K.) attached with a printing head KJT-256-8MGF1 (trade name, available from Kyocera Co.) under the conditions of an applied pulse width of 1.1 msec and an applied voltage of 26 volts, and this was preserved in an atmosphere wherein a temperature of 50° C. and a relative humidity of 20% for 24 hours, and then, the densities were measured in the same manner as in Test 1. Image residual ratio was calculated from the following equation.

$$A=(C/B)\times 100$$

wherein A represents an image residual ratio (%); B represents an image density before the test; and C represents an image density after the test.

The results of Tests 1 to 4 of the reversible heat-sensitive recording materials in Examples 1–70 and Comparative examples 1–20 are shown in the following Table 3.

TABLE 3

| | Test 1 (Density at colored portion) | Test 2 (Density at decolorized portion) | Test 3 (Decolorization starting temperature (° C.)) | Test 4 (Image residual ratio (%)) |
|---|---|---|---|---|
| Example 1 | 1.22 | 0.08 | 130 | 95 |
| Example 2 | 1.25 | 0.08 | 130 | 101 |
| Example 3 | 1.25 | 0.08 | 140 | 100 |
| Example 4 | 1.30 | 0.08 | 140 | 110 |
| Example 5 | 1.33 | 0.11 | 140 | 110 |
| Example 6 | 1.20 | 0.08 | 140 | 91 |
| Example 7 | 1.17 | 0.07 | 130 | 90 |
| Example 8 | 1.20 | 0.08 | 130 | 93 |
| Example 9 | 1.22 | 0.12 | 140 | 96 |
| Example 10 | 1.20 | 0.13 | 130 | 85 |
| Example 11 | 1.20 | 0.08 | 130 | 88 |
| Example 12 | 1.22 | 0.08 | 130 | 87 |
| Example 13 | 1.35 | 0.08 | 130 | 89 |
| Example 14 | 1.38 | 0.09 | 130 | 91 |
| Example 15 | 1.20 | 0.08 | 130 | 89 |
| Example 16 | 1.20 | 0.07 | 130 | 82 |
| Example 17 | 1.30 | 0.10 | 130 | 85 |
| Example 18 | 1.22 | 0.08 | 130 | 88 |
| Example 19 | 1.27 | 0.08 | 130 | 86 |
| Example 20 | 1.30 | 0.09 | 130 | 85 |
| Example 21 | 1.15 | 0.07 | 130 | 82 |
| Example 22 | 1.10 | 0.07 | 120 | 80 |
| Example 23 | 0.92 | 0.07 | 130 | 80 |
| Example 24 | 0.95 | 0.08 | 130 | 80 |
| Example 25 | 1.14 | 0.07 | 130 | 81 |
| Example 26 | 1.10 | 0.07 | 120 | 80 |
| Example 27 | 1.10 | 0.07 | 120 | 80 |
| Example 28 | 1.02 | 0.08 | 120 | 78 |
| Example 29 | 0.88 | 0.10 | 120 | 77 |
| Example 30 | 0.90 | 0.09 | 130 | 80 |
| Example 31 | 1.20 | 0.08 | 120 | 80 |
| Example 32 | 1.18 | 0.07 | 120 | 77 |
| Example 33 | 1.20 | 0.07 | 110 | 80 |
| Example 34 | 1.18 | 0.07 | 110 | 77 |
| Example 35 | 1.22 | 0.09 | 120 | 75 |
| Example 36 | 1.20 | 0.09 | 120 | 75 |
| Example 37 | 1.20 | 0.07 | 110 | 90 |
| Example 38 | 1.20 | 0.07 | 110 | 87 |
| Example 39 | 1.10 | 0.07 | 110 | 88 |
| Example 40 | 1.05 | 0.07 | 100 | 85 |
| Example 41 | 0.90 | 0.07 | 110 | 80 |
| Example 42 | 0.94 | 0.07 | 110 | 80 |
| Example 43 | 1.22 | 0.07 | 120 | 90 |
| Example 44 | 1.20 | 0.07 | 120 | 89 |
| Example 45 | 1.18 | 0.07 | 100 | 90 |
| Example 46 | 1.08 | 0.07 | 90 | 82 |
| Example 47 | 0.92 | 0.07 | 100 | 80 |
| Example 48 | 0.94 | 0.07 | 100 | 82 |

TABLE 3-continued

| | Test 1 (Density at colored portion) | Test 2 (Density at decolorized portion) | Test 3 (Decolorization starting temperature (° C.)) | Test 4 (Image residual ratio (%)) |
|---|---|---|---|---|
| Example 49 | 1.10 | 0.08 | 120 | 75 |
| Example 50 | 1.10 | 0.08 | 120 | 72 |
| Example 51 | 1.12 | 0.07 | 110 | 72 |
| Example 52 | 0.90 | 0.07 | 110 | 70 |
| Example 53 | 1.27 | 0.07 | 120 | 82 |
| Example 54 | 1.25 | 0.07 | 120 | 80 |
| Example 55 | 1.13 | 0.07 | 100 | 75 |
| Example 56 | 1.03 | 0.07 | 90 | 76 |
| Example 57 | 0.95 | 0.07 | 100 | 75 |
| Example 58 | 0.95 | 0.07 | 100 | 75 |
| Example 59 | 1.27 | 0.07 | 120 | 84 |
| Example 60 | 1.26 | 0.07 | 120 | 82 |
| Example 61 | 1.15 | 0.07 | 100 | 85 |
| Example 62 | 1.10 | 0.07 | 90 | 82 |
| Example 63 | 0.94 | 0.07 | 100 | 87 |
| Example 64 | 0.90 | 0.07 | 100 | 86 |
| Example 65 | 1.10 | 0.07 | 120 | 77 |
| Example 66 | 1.10 | 0.07 | 120 | 72 |
| Example 67 | 1.05 | 0.07 | 110 | 72 |
| Example 68 | 1.00 | 0.07 | 110 | 70 |
| Example 69 | 1.12 | 0.07 | 100 | 75 |
| Example 70 | 1.02 | 0.07 | 90 | 71 |
| Comparative example 1 | 0.51 | 0.33 | — | 19 |
| Comparative example 2 | 0.55 | 0.48 | — | 23 |
| Comparative example 3 | 0.63 | 0.55 | — | 26 |
| Comparative example 4 | 1.04 | 0.31 | — | 29 |
| Comparative example 5 | 1.01 | 0.30 | 130 | 25 |
| Comparative example 6 | 1.33 | 0.20 | 120 | 30 |
| Comparative example 7 | 0.65 | 0.07 | 120 | 90 |
| Comparative example 8 | 1.22 | 0.10 | 150 | 48 |
| Comparative example 9 | 1.20 | 0.10 | 150 | 40 |
| Comparative example 10 | 1.04 | 0.07 | 150 | 34 |
| Comparative example 11 | 0.61 | 0.07 | 140 | 25 |
| Comparative example 12 | 0.44 | 0.07 | 140 | 31 |
| Comparative example 13 | 0.47 | 0.07 | 140 | 30 |
| Comparative example 14 | 1.10 | 0.17 | 120 | 21 |
| Comparative example 15 | 1.10 | 0.17 | 120 | 22 |
| Comparative example 16 | 0.60 | 0.07 | 120 | 62 |
| Comparative example 17 | 0.63 | 0.07 | 120 | 50 |
| Comparative example 18 | 0.82 | 0.10 | 150 | 28 |
| Comparative example 19 | 0.71 | 0.07 | 150 | 20 |
| Comparative example 20 | 0.40 | 0.07 | 150 | 20 |

As shown in Table 3, in a reversible heat-sensitive recording material containing a generally colorless or pale color dye precursor and a reversible color developing agent which forms reversible color change in said dye precursor by heating, by using the compound represented by the formula (I) as the reversible color developing agent or using any of the compounds represented by the formulae (II) to (IX) as a decolorization promoter, reversible heat-sensitive recording materials which have clear contrast, formation and decolorization of image are possible within a short period of time and stable image can be maintained under everyday life environments with a lapse of time can be obtained.

What we claimed is:

1. A reversible heat-sensitive recording material which comprises a support and a reversible heat-sensitive recording layer containing a dye precursor which is usually colorless or a pale color and a reversible color developing agent capable of causing a reversible change in color density of said dye precursor due to the difference in cooling rate after heating, and said reversible color developing agent is a compound represented by the following formula (I):

(I)

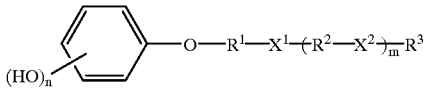

wherein $R^1$ and $R^2$ may be the same or different from each other and each represent a divalent hydrocarbon group having 1 to 18 carbon atoms; $R^3$ represents a hydrocarbon group having 1 to 24 carbon atoms; $X^1$ represents a divalent connecting group having at least one —CONH— bonding; $X^2$ represents an oxygen atom or a sulfur atom; n is an integer of 1 to 3; and m is 0 or 1.

2. The reversible heat-sensitive recording material according to claim 1, wherein $R^1$, $R^2$ and $R^3$ in the formula (I) of the reversible color developing agent are each hydrocarbon group having 1 to 11 carbon atoms.

3. The reversible heat-sensitive recording material according to claim 1, wherein $R^1$ in the formula (I) of the reversible color developing agent an aliphatic hydrocarbon group.

4. The reversible heat-sensitive recording material according to claim 1, wherein the reversible heat-sensitive recording layer contains at least one decolorization promoting agent selected from the group consisting of the compounds represented by the following formulae (II) to (IX):

$$A—(Ra)_h—Xa—Rb \quad (II)$$

wherein A represents a substituent having at least one nitrogen atom; Ra represents a divalent hydrocarbon group having 1 to 12 carbon atoms; Xa represents a divalent group having at least one —CONH— bonding; Rb represents a hydrocarbon group having 1 to 24 carbon atoms, and an oxygen atom or a sulfur atom may be contained in the group; and h represents 0 or 1.

(III)

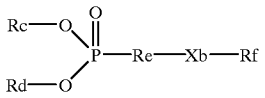

wherein Rc and Rd may be the same or different from each other and each represent a hydrocarbon group having 1 to 24 carbon atoms; Re represents a divalent hydrocarbon group having 1 to 12 carbon atoms; Rf represents a hydrocarbon group having 1 to 28 carbon atoms, and an oxygen atom or a sulfur atom may be contained in the group; and Xb represents a divalent group having at least one —CONH— bonding.

(IV)

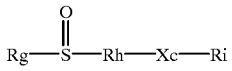

wherein Rg and Ri may be the same or different from each other and each represent a hydrocarbon group having 1 to 24 carbon atoms; Rh represents a divalent hydrocarbon group having 1 to 12 carbon atoms; and Xc represents a divalent group having at least one —CONH— bonding.

(V)

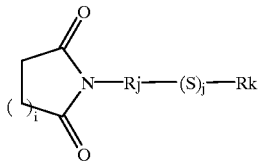

wherein Rj represents a divalent hydrocarbon group having 1 to 12 carbon atoms; Rk represents a hydrocarbon group having 1 to 24 carbon atoms; i is an integer of 1 to 3; and j represents 0 or 1.

(VI)

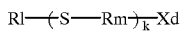

wherein Rl represents a divalent hydrocarbon group having 1 to 24 carbon atoms; Rm represents a divalent hydrocarbon group having 1 to 12 carbon atoms; Xd represents a divalent group having at least one —CONH— bonding; and k represents 0 or 1, provided that when k=0, Xd does not contain a mere amido bonding.

(VII)

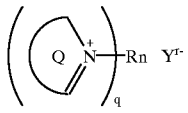

wherein Q represents a heterocyclic aromatic ring; Rn represents a monovalent or more of hydrocarbon atoms having 6 to 24 carbon atoms; q is an integer of 1 or 2; Y represents an anion; and r is a number necessary for adjusting the charge in the molecule to 0.

(VIII)

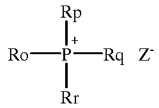

wherein Ro, Rp, Rq and Rr may be the same or different from each other and each represent an alkyl group, an alkenyl group, a cycloalkyl group, an aralkyl group, an aryl group or a heterocyclic residue, and optional two groups selected from Ro to Rr may be combined to each other to form a cyclic structure; and $Z^-$ represents an anion, (IX)

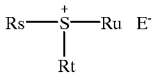

wherein Rs, Rt and Ru may be the same or different from each other and each represent an alkyl group, an alkenyl group, a cycloalkyl group, an aralkyl group, an aryl group or a heterocyclic residue, and optional two groups selected from Rs to Ru may be combined to each other to form a cyclic structure; and $E^-$ represents an anion.

5. The reversible heat-sensitive recording material according to claim 1, wherein m of the reversible color developing agent represented by the formula (I) is 0, n is 1, $R^1$ and $R^3$ are each aliphatic hydrocarbon group having 1 to 11 carbon atoms, and $X^1$ is a —CONHNHCO— bond.

6. The reversible heat-sensitive recording material according to claim 1, wherein m and n of the reversible color developing agent represented by the formula (I) are each 1, $R^1$, $R^2$ and $R^3$ each represent aliphatic hydrocarbon groups having 1 to 11 carbon atoms, $X^1$ is a —CONHNHCO— bond, and $X^2$ is a sulfur atom.

* * * * *